US009348246B2

(12) United States Patent
Magome et al.

(10) Patent No.: US 9,348,246 B2
(45) Date of Patent: May 24, 2016

(54) DEVELOPING APPARATUS, DEVELOPING METHOD, IMAGE FORMING APPARATUS AND IMAGE FORMING METHOD

(71) Applicant: CANON KABUSHIKI KAISHA, Tokyo (JP)

(72) Inventors: Michihisa Magome, Mishima (JP); Takashi Matsui, Mishima (JP); Kozue Uratani, Mishima (JP); Atsuhiko Ohmori, Suntou-gun (JP); Masaki Yamada, Mishima (JP); Minoru Ito, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 1 day.

(21) Appl. No.: 14/568,061

(22) Filed: Dec. 11, 2014

(65) Prior Publication Data

US 2015/0185643 A1 Jul. 2, 2015

(30) Foreign Application Priority Data

Dec. 26, 2013 (JP) ..... 2013-270525

(51) Int. Cl.

| | |
|---|---|
| ***G03G 15/08*** | (2006.01) |
| ***G03G 9/083*** | (2006.01) |
| ***G03G 9/08*** | (2006.01) |
| ***G03G 9/087*** | (2006.01) |
| ***G03G 9/097*** | (2006.01) |

(52) U.S. Cl.

CPC ..... *G03G 9/083* (2013.01); *G03G 9/0806* (2013.01); *G03G 9/0833* (2013.01); *G03G 9/08711* (2013.01); *G03G 9/09725* (2013.01)

(58) Field of Classification Search

CPC ... G03G 9/083; G03G 9/0806; G03G 9/0833; G03G 9/08711; G03G 9/09725

See application file for complete search history.

(56) References Cited

U.S. PATENT DOCUMENTS

| | | | |
|---|---|---|---|
| 6,555,282 | B2 | 4/2003 | Okuno et al. |
| 7,239,831 | B2 | 7/2007 | Hagiwara et al. |

FOREIGN PATENT DOCUMENTS

| | | | |
|---|---|---|---|
| JP | 57-5047 | A | 1/1982 |
| JP | 2002-108001 | A | 4/2002 |
| JP | 2005-173484 | A | 6/2005 |
| JP | 2006-154093 | A | 6/2006 |
| JP | 2012-189876 | A | 10/2012 |

*Primary Examiner* — Peter Vajda

(74) *Attorney, Agent, or Firm* — Fitzpatrick, Cella, Harper and Scinto

(57) ABSTRACT

The present invention provides a developing apparatus including a toner, a toner carrying member and a regulating member, wherein the toner is a magnetic toner including a toner particle, a first fine silica particle having a number average primary particle diameter of 5 to 20 nm and a second fine silica particle having a number average primary particle diameter of 40 to 200 nm, the second fine silica particle is a fine silica particle produced by a sol-gel method, the toner has a total energy of 270 to 355 mJ/(g/ml), the toner carrying member has a substrate, an elastic layer and a surface layer including a urethane resin, and the urethane resin has a partial structure derived from a reaction of a particular amine type compound with a polyisocyanate.

8 Claims, 2 Drawing Sheets

DEVELOPING APPARATUS, DEVELOPING METHOD, IMAGE FORMING APPARATUS AND IMAGE FORMING METHOD

BACKGROUND OF THE INVENTION

1. Field of the Invention

The present invention relates to a developing apparatus, a developing method, an image forming apparatus and an image forming method utilizing an electrophotographic method.

2. Description of the Related Art

A large number of electrophotographic methods are known, and in general, a photoconductive substance is utilized and various units are used to form an electrostatic latent image on an electrostatic latent image bearing member. Then, the electrostatic latent image is developed by a toner to be formed into a visible image, a toner image is, if necessary, transferred to a recording medium such as paper, and the toner image is then fixed on the recording medium by heat or pressure to provide a copy. Such an image forming apparatus includes a copier and a printer.

Such printer and copier have been converted from an analog type to a digital type in recent years, and have been strongly demanded to be excellent in reproducibility of a latent image and to have a high resolution, and, at the same time, in particular the printer has been strongly demanded to be reduced in size.

Heretofore, a printer has been often used in such a manner that the printer is connected to network and used by a large number of persons for printing, but, in recent years, a PC and a printer have been increasingly demanded to be placed on a desk for each individual and used for printing thereat. A printer is thus required to be smaller in footprint, and is strongly demanded to be reduced in size.

In addition, even such a compact printer is highly demanded to provide a high-quality image and to be high in durability so as to provide an image small in fluctuation of quality even for a long time of use.

In focusing on a reduction in size of the printer here, it is mainly effective for the reduction in size to reduce a fixing unit and a developing apparatus in size. In particular, the developing apparatus accounts for a significant portion of the printer, and the reduction in size of the developing apparatus can be said to be essential for the reduction in size of the printer.

With respect to a developing system, a developing system for the printer, including a 2-component developing system and a 1-component developing system, is suitably a 1-component developing system which is compact. The reason for this is because a member such as a carrier is not used in the 1-component developing system.

Then, with respect to the reduction in size in the 1-component development, it is effective for the reduction in size of the developing apparatus to reduce the diameter of an electrostatic latent image bearing member or a toner carrying member. In terms of high image quality, a developing system (hereinafter, referred to as "contact developing system") can be adopted in which the toner carrying member and the electrostatic latent image bearing member are arranged in contact with each other.

The contact developing system in which the diameter of the toner carrying member is lowered, however, puts an increased load on a toner, easily causing the reduction in image quality for a long period of use. The reason for this is because the diameter of the toner carrying member is lowered, thereby, for example, causing the increase in number of passages through a toner supply member arranged in contact with the toner carrying member or the increase in curvature to result in the increase in abutment pressure at an abutment portion.

The toner supply member has been conventionally rotated in the same direction as in the toner carrying member, and the respective movement directions at the abutment portion of the toner supply member and the toner carrying member have been often opposite to each other. The reason for this is because it is easy to scrape a toner not developed and at the same time supply a fresh toner, and thus the increase in image quality is easily achieved.

Such a system in which the toner carrying member and the toner supply member are rotated in the same direction easily provides a high image quality, but has the following problem: the toner carrying member and the toner supply member are moved in the opposite direction to each other at the abutment portion therebetween to easily cause toner deterioration for a long period of use.

On the contrary, for the purpose of decreasing the load on a toner to maintain a high durability, a system has been started to be adopted in recent years in which the toner carrying member and the toner supply member are rotated in the opposite direction to each other to decrease the fluctuation in image quality even for a long time of use. Alternatively, an attempt has also been proposed in which no toner supply member is used to thereby maintain a higher durability (see Japanese Patent Application Laid-Open No. 2005-173484 and Japanese Patent Application Laid-Open No. 2006-154093).

In such a developing apparatus, however, the particular problem tends to be easily exposed. One is the problem called "regulation failure". The regulation failure refers to a phenomenon in which a difference is made between the amount of a toner on the toner carrying member immediately after the consumption of a toner (hereinafter, referred to as "after black imaging") and the amount of a toner on the toner carrying member in the state of no consumption of a toner in a non-printing region or the like (hereinafter, referred to as "after white"), specifically, refers to a state where the amount of a toner on the toner carrying member after white is larger.

If such a regulation failure is caused, for example, an image defect called "ghost", namely, an image defect including spot-like and wave-like variations on a non-printing area, and a toner lump on an image is caused.

With respect to the regulation failure here, the regulation failure is caused by pasting a toner on the toner carrying member onto the toner carrying member by a mirroring force or the like, and in particular is easily caused under a low-temperature and low-humidity environment.

For the reduction in attachment force, an attempt has been proposed in which a silica having particular water content and volume resistivity, produced by a sol-gel method, is used to reduce the physical attachment force of a toner (see Japanese Patent Application Laid-Open No. 2002-108001).

In addition, a toner has also been proposed which is good in fluidity and excellent in charge stability by combination use of a silica produced by a sol-gel method and a silica produced by a dry method (see Japanese Patent Application Laid-Open No. 2012-189876).

Such techniques, however, are insufficient particularly in terms of the effect in the case of a long period of use in a low-printing rate, and have a room for improvement.

On the other hand, the reduction in amount of a toner charged and the reduction in mirroring force solve the regulation failure, but fogging in a no image region is severer under a high-temperature and high-humidity environment, and there is a room for improvement in suppressing the regulation failure under a low-temperature and low-humidity environment and the fogging under a high-temperature and high-humidity environment at the same time.

SUMMARY OF THE INVENTION

The present invention is directed to providing a developing apparatus, a developing method, an image forming apparatus and an image forming method that provide an image with suppressed fogging under a high-temperature and high-humidity environment, and that suppress the regulation failure under a low-temperature and low-humidity environment.

According to one aspect of the present invention, there is provided a developing apparatus for developing an electrostatic latent image formed on a surface of an electrostatic latent image bearing member to form a toner image on the surface of the electrostatic latent image bearing member, wherein the developing apparatus includes a toner for developing the electrostatic latent image, a toner carrying member for carrying the toner, and a regulating member for regulating a layer thickness of the toner carried by the toner carrying member, the toner is a magnetic toner including a toner particle containing a binder resin and a magnetic member, a first fine silica particle having a number average primary particle diameter (D1) of 5 nm or more and 20 nm or less, and a second fine silica particle having a number average primary particle diameter (D1) of 40 nm or more and 200 nm or less, the second fine silica particle is a fine silica particle produced by a sol-gel method, the toner has a total energy of 270 mJ/(g/ml) or more and 355 mJ/(g/ml) or less, the toner carrying member has a substrate, an elastic layer and a surface layer including a urethane resin, and the urethane resin has a partial structure derived from a reaction of a compound represented by the following structural formula (1) with a polyisocyanate:

Structural formula (1)

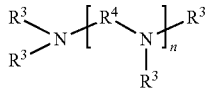

wherein n denotes an integer of 1 or more and 4 or less, each $R^3$ independently represents any selected from the group consisting of the following (a) to (c): (a) a hydroxyalkyl group having 2 or more and 8 or less carbon atoms; (b) an aminoalkyl group having 2 or more and 8 or less carbon atoms; and (c) a group represented by the following structural formula (2), and $R^4$ represents an alkylene group having 2 or more and 4 or less carbon atoms:

Structural formula (2)

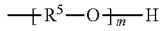

wherein m denotes an integer of 2 or more and 3 or less, and $R^5$ represents an alkylene group having 2 or more and 5 or less carbon atoms.

According to another aspect of the present invention, there is provided a developing method including using a developing apparatus for developing an electrostatic latent image formed on a surface of an electrostatic latent image bearing member to form a toner image on the surface of the electrostatic latent image bearing member, wherein the developing apparatus includes a toner for developing the electrostatic latent image, a toner carrying member for carrying the toner, and a regulating member for regulating a layer thickness of the toner carried by the toner carrying member, the toner is a magnetic toner including a toner particle containing a binder resin and a magnetic member, a first fine silica particle having a number average primary particle diameter (D1) of 5 nm or more and 20 nm or less, and a second fine silica particle having a number average primary particle diameter (D1) of 40 nm or more and 200 nm or less, the second fine silica particle is a fine silica particle produced by a sol-gel method, the toner has a total energy of 270 mJ/(g/ml) or more and 355 mJ/(g/ml) or less, the toner carrying member has a substrate, an elastic layer and a surface layer including a urethane resin, and the urethane resin has a partial structure derived from a reaction of a compound represented by the structural formula (1) with a polyisocyanate.

According to further aspect of the present invention, there is provided an image forming apparatus including an electrostatic latent image bearing member, a charging unit for charging a surface of the electrostatic latent image bearing member, an image exposure unit for irradiating the charged surface of the electrostatic latent image bearing member with light for image exposure to form an electrostatic latent image on the surface of the electrostatic latent image bearing member, a developing apparatus for developing the electrostatic latent image formed on the surface of the electrostatic latent image bearing member to form a toner image on the surface of the electrostatic latent image bearing member, a transfer unit for transferring the toner image formed on the surface of the electrostatic latent image bearing member to a transfer material via or not via an intermediate transfer member, and a fixing unit for fixing the toner image transferred to the transfer material onto the transfer material, wherein the developing apparatus is the developing apparatus of the present invention.

According to further aspect of the present invention, there is provided an image forming method including charging a surface of an electrostatic latent image bearing member, irradiating the charged surface of the electrostatic latent image bearing member with light for image exposure to form an electrostatic latent image on the surface of the electrostatic latent image bearing member, developing the electrostatic latent image formed on the surface of the electrostatic latent image bearing member to form a toner image on the surface of the electrostatic latent image bearing member, transferring the toner image formed on the surface of the electrostatic latent image bearing member to a transfer material via or not via an intermediate transfer member, and fixing the toner image transferred to the transfer material onto the transfer material, wherein the developing is performed by the developing method of the present invention.

The present invention can provide a developing apparatus, a developing method, an image forming apparatus and an image forming method that provide an image with suppressed fogging under a high-temperature and high-humidity environment and that suppress the regulation failure under a low-temperature and low-humidity environment.

Further features of the present invention will become apparent from the following description of exemplary embodiments with reference to the attached drawings.

DESCRIPTION OF THE EMBODIMENTS

Figure 1:
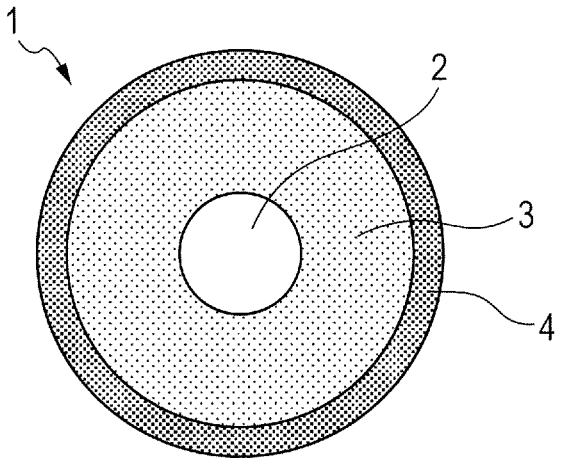
FIG. 1 is a schematic cross-sectional view illustrating one example of a toner carrying member according to the present invention.

Preferred embodiments of the present invention will now be described in detail in accordance with the accompanying drawings.

The developing apparatus of the present invention is a developing apparatus for developing an electrostatic latent image formed on the surface of an electrostatic latent image bearing member to form a toner image on the surface of the electrostatic latent image bearing member, wherein the developing apparatus includes a toner for developing the electrostatic latent image, a toner carrying member for carrying the toner, and a regulating member for regulating the layer thickness of the toner carried by the toner carrying member, the toner is a magnetic toner including a toner particle containing a binder resin and a magnetic member, a first fine silica particle having a number average primary particle diameter (D1) of 5 nm or more and 20 nm or less, and a second fine silica particle having a number average primary particle diameter (D1) of 40 nm or more and 200 nm or less, the second fine silica particle is a fine silica particle produced by a sol-gel method, the toner has a total energy of 270 mJ/(g/ml) or more and 355 mJ/(g/ml) or less, the toner carrying member has a substrate, an elastic layer and a surface layer including a urethane resin, and the urethane resin has a partial structure derived from a reaction of a compound represented by the following structural formula (1) with a polyisocyanate:

Structural formula (1)

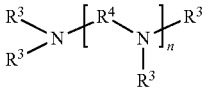

wherein n denotes an integer of 1 or more and 4 or less, each $R^3$ independently represents any selected from the group consisting of the following (a) to (c):

(a) a hydroxyalkyl group having 2 or more and 8 or less carbon atoms;

(b) an aminoalkyl group having 2 or more and 8 or less carbon atoms; and (c) a group represented by the following structural formula (2), and $R^4$ represents an alkylene group having 2 or more and 4 or less carbon atoms:

Structural formula (2)

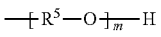

wherein m denotes an integer of 2 or more and 3 or less, and $R^5$ represents an alkylene group having 2 or more and 5 or less carbon atoms.

The present inventors have studied in detail, and as a result, have found that a toner carrying member containing a particular compound in a surface layer, and a toner including a silica produced by a sol-gel method and having particular powder characteristics are used in combination to thereby enable the regulation failure under a low-temperature and low-humidity environment and the fogging under a high-temperature and high-humidity environment to be simultaneously suppressed.

The reason for this is described as follows.

First, it is considered that, with respect to the fogging under a high-temperature and high-humidity environment, the following two conditions are required for achieving uniform chargeability under a high-temperature and high-humidity environment where a toner is hardly charged. One condition is a high chargeability of a member, and another condition is many charging opportunities. With respect to the chargeability of a member, as the first condition, a toner can be brought into contact with and frictioned with the toner carrying member to thereby be charged. Then, the present inventors have variously studied about a compound to be contained in the surface layer of the toner carrying member, and as a result have found that the charging ability of the compound represented by structural formula (1) is high. The reason for this is because the compound represented by structural formula (1) has a nitrogen atom (N) at the center and the nitrogen atom has a lone electron pair (lone pair), and thus the compound represented by structural formula (1) is a Lewis base. The Lewis base has electron donating property, and thus a toner can be brought into contact with the compound represented by structural formula (1) to achieve rapid charging. In addition, the compound represented by structural formula (1) reacts with an isocyanate to thereby form a crosslinking structure in which a large number of urethane groups or urea groups are generated around the structure of the compound represented by structural formula (1). As a result, microhardness is made higher, and a toner less puts a dent in the surface of the toner carrying member even when being regulated at a part (hereinafter, abbreviated as "regulating part") where a toner regulating member abuts with the toner carrying member. As a result, good rolling properties of a toner can be maintained, and the chargeability of a toner is enhanced.

Furthermore, in a low-molecular weight and multi-functional compound, all functional groups generally tend to hardly react due to a steric barrier. The compound represented by structural formula (1), however, has an amino backbone in the molecule, has high reactivities of a hydroxyl group and an amino group at the terminals, and thus less generates the unreacted component. Thus, the uniformity in charging can be further enhanced and the uniformity of the crosslinking structure can be increased.

Then, the second condition, many charging opportunities, is described. A toner is conveyed by the toner carrying member, and a force conveyed by the toner carrying member and a force due to pressing from a regulating blade act upon the toner at the regulating part. As a result, the toner on the surface of the toner carrying member is conveyed with being exchanged in an admixing manner. In addition, the toner is exchanged with a toner at the regulating part to thereby be brought into contact with the toner carrying member and slid. Therefore, the toner is charged to have a charge.

It is here important that the toner be exchanged with a toner on the toner carrying member, and it is considered that the toner favorably exchanged encounters many charging opportunities. Here, it is important that the toner for use in the present invention have a total energy of 270 mJ/(g/ml) or more and 355 mJ/(g/ml) or less. The total energy refers to a physical property value represented as a stress required for relieving the pressure applied for compacting the toner, and an index indicating loosing property at the regulating part. When the total energy is 355 mJ/(g/ml) or less, the toner is easily loosed, and can be favorably exchanged on the toner carrying member. On the other hand, when the total energy is less than 270 mJ/(g/ml), an image defect can be caused in many cases. In order that the total energy is less than 270 mJ/(g/ml), for example, it is necessary to add an external additive in a large amount, or to add a second fine silica particle produced by a sol-gel method, described later, in a large amount. In such a case, the external additive is present in a large amount to thereby cause desired chargeability not to be achieved, causing fogging and attaching the external additive to the toner regulating member to thereby easily cause an image streak. Therefore, it is important that the total energy of the toner for use in the present invention be 270 mJ/(g/ml) or more and 355 mJ/(g/ml) or less.

As described above, the toner for use in the present invention is a toner that is easily loosed, and thus is good in exchange property at the regulating part and can encounter many charging opportunities.

As described above, the toner carrying member for use in the present invention has the compound represented by structural formula (1) in the surface layer, and thus has high chargeability. In addition, the toner for use in the present invention has a low total energy and is easily loosed, and thus can encounter many charging opportunities. The synergetic effect of such two points enables uniform and high chargeability to be achieved even under a high-temperature and high-humidity environment where charging is hardly made, and enables fogging to be suppressed.

Furthermore, when the toner carrying member is arranged in contact with the electrostatic latent image bearing member, the problem due to contact arrangement is also clear. The problem is as follows: when the toner on the toner carrying member passes through the abutment portion (hereinafter, abbreviated as "developing abutment portion") with the electrostatic latent image bearing member, the amount of the toner charged is reduced or the charging of the toner is inversed to cause fogging to be severer. Such a phenomenon is more remarkably caused as the width of the developing abutment portion is wider.

While the detail about the reduction in amount of the toner charged, due to the passage of the toner through the developing abutment portion, is not clear, the present invention is also very effective for solving the reduction. As described above, the toner carrying member for use in the present invention has high chargeability and high microhardness. Furthermore, the toner is easily loosed and thus can be favorably rolled on the toner carrying member even during passing through the developing abutment portion, and the amount of the toner charged can be kept uniform and large. Therefore, even when the developing abutment portion is wide, the toner has no reduced chargeability during passing through the developing abutment portion, not causing fogging to be severer.

Then, the regulation failure under a low-temperature and low-humidity environment is described. As described above, the toner carrying member for use in the present invention has the compound represented by structural formula (1) in the surface layer, and has high chargeability. Such properties are again achieved even under a low-temperature and low-humidity environment, and the amount of a toner charged tends to be larger. In particular, the amount charged after white is very large, and a larger mirroring force increases the amount of a toner on the toner carrying member to easily cause the regulation failure.

On the contrary, the toner for use in the present invention has the second fine silica particle produced by a sol-gel method. The fine silica particle produced by a sol-gel method has many hydroxyl groups on the surface thereof, and the toner is hardly overcharged. Therefore, the increase in mirroring force can be suppressed. Furthermore, the number average primary particle diameter (D1) of the fine silica particle produced by a sol-gel method is as relatively large as 40 nm or more and 200 nm or less, and thus a toner particle encounters reduced opportunities so as to be directly brought into contact with the toner carrying member. Therefore, the Van der Waals force acting between the toner and the toner carrying member is also considered to be reduced. The attachment force between the toner and the toner carrying member is the sum of the mirroring force and the Van der Waals force. Accordingly, the fine silica particle having a number average primary particle diameter (D1) of 40 nm or more and 200 nm or less, produced by a sol-gel method, can be used to thereby significantly reduce the attachment force between the toner and the toner carrying member.

In addition, the toner energy of the toner for use in the present invention is low and the toner is easily loosed. Furthermore, the toner for use in the present invention has a silica particle having a number average primary particle diameter of 6 nm or more and 20 nm or less, and the fluidity of the toner is very high.

The above three effects, namely, a significant reduction in attachment force between the toner and the toner carrying member, and the synergetic effect of a high fluidity at the regulating part and high loosing property allow the amount of the toner on the toner carrying member not to be increased even after white, enabling the regulation failure to be suppressed.

From the foregoing, a significant suppression of fogging under a high-temperature and high-humidity environment, and the suppression of regulation failure under a low-temperature and low-humidity environment can be simultaneously satisfied for the first time.

Herein, when the number average primary particle diameter (D1) of the first fine silica particle of the toner for use in the present invention is more than 20 nm, the fluidity of the toner can be deteriorated and the regulation failure can be further caused. On the other hand, when the number average primary particle diameter (D1) is less than 6 nm, the fine silica particle can be easily aggregated and present as an aggregate to thereby hardly achieve a desired fluidity.

When a fumed silica is used instead of the fine silica particle produced by a sol-gel method, as the second fine silica particle, the amount of the toner charged after white can be increased and the regulation failure can be further caused.

The total energy of the toner for use in the present invention can be arbitrarily changed depending on the amount of the fine silica particle produced by a sol-gel method, the amount of the first fine silica particle, addition of other external additive, external addition conditions, and the like.

Specifically, as the amount of the fine silica particle produced by a sol-gel method is larger, the total energy tends to be lowered, and, for example, even if titanium oxide is added, the total energy can also be suppressed.

The toner for use in the present invention can be produced by adding and mixing the second fine silica particle produced by a sol-gel method to and with the toner particle, and then adding and mixing the first fine silica particle thereto and therewith. As described above, the second fine silica particle has a relatively large number average primary particle diameter (D1), has a small attachment force to the toner particle, and is easily free.

Therefore, the second fine silica particle produced by a sol-gel method is added and mixed and then the first fine silica particle is added and mixed thereto and therewith, thereby resulting the enhancement in the rate of attachment of the second fine silica particle to the toner particle. Thus, the second fine silica particle produced by a sol-gel method can remain on the toner surface in a sufficient amount even for a long period of use, and the regulation failure can be further suppressed even for a long period of use.

The toner for use in the present invention has the second fine silica particle produced by a sol-gel method. The amount of the second fine silica particle added is preferably 0.05 parts by mass or more and 1.0 part by mass or less, more preferably 0.1 parts by mass or more and 0.7 parts by mass or less, based on 100 parts by mass of the toner particle. When the amount falls within such a range, the total energy of the toner can be easily controlled and the effect of the present invention can be more suitably exerted.

While the toner for use in the present invention has the first fine silica particle, the first fine silica particle can be obtained by treating a silica raw material with a silicone oil and then with at least one of alkoxysilane and silazane.

Such a fine silica particle can be used to thereby provide less aggregate of the fine silica particle itself, imparting a very high fluidity to the toner. As a result, the regulation failure is further suppressed.

The fine silica particle can have a rate of immobilization of the silicone oil on the fine silica particle on carbon basis, of 90% or more. The rate of immobilization of the oil on the fine silica particle is 90% or more, namely, it is indicated that most of the oil is attached to the fine silica particle. As a result, the fogging under a high-temperature and high-humidity environment can be suppressed and the regulation failure can be much suppressed.

The weight average particle diameter (D4) of the toner for use in the present invention is preferably 5.0 μm or more and 12.0 μm or less, more preferably 5.5 or more and 11.0 μm or less. When the weight average particle diameter (D4) falls within the above range, a high fluidity is achieved, and development can be made in faithful accordance with a latent image. Therefore, a good image excellent in dot reproducibility can be obtained.

The toner for use in the present invention preferably has a ratio of the weight average particle diameter (D4) to the number average particle diameter (D1), D4/D1, of 1.30 or less, more preferably 1.25 or less. The D4/D1 is 1.30 or less, namely, it is meant that the particle size distribution of the toner is sharp.

As described above, it is important that the toner for use in the present invention have a small attachment force with the toner carrying member. The attachment force also depends on the toner particle diameter. The smaller the particle diameter is, the larger the attachment force is, and the larger the particle diameter is, the smaller the attachment force is. Therefore, when the particle size distribution is shape, the fluctuation in attachment force among individual toners can be decreased and the toner can be easily further exchanged at the regulating part.

The average degree of circularity of the toner for use in the present invention can be 0.950 or more. When the average degree of circularity of the toner is 0.950 or more, the toner has a spherical or almost spherical shape, is excellent in fluidity, easily achieves uniform frictional chargeability, and provides further suppressed fogging under a high-temperature and high-humidity environment.

The glass transition temperature (Tg) of the toner for use in the present invention can be 40.0° C. or higher and 70.0° C. or lower. When the glass transition temperature falls within the above range, the enhancements in storage stability and durability can be achieved with a good fixability being maintained.

The binder resin of the toner for use in the present invention includes a vinyl type resin and a polyester type resin, but is not particularly limited and a conventionally known resin can be used.

Specifically, homopolymers of styrene and a substituted styrene, such as polystyrene and polyvinyltoluene; styrene type copolymers such as a styrene-propylene copolymer, a styrene-vinyltoluene copolymer, a styrene-vinylnaphthaline copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, a polyester resin, a polyamide resin, an epoxy resin, and a polyacrylic resin can be used, and such resins can be used singly or in combination of two or more. Among such resins, a styrene type copolymer and a polyester resin can particularly be adopted in terms of e.g., developing characteristics and fixability.

The toner for use in the present invention may also be, if necessary, compounded with a charge control agent for the purpose of the enhancement in charging characteristics. As the charge control agent, a known agent can be utilized, but, in particular, a charge control agent can be adopted which is high in charging speed and which can allow a constant amount charged to be stably maintained. Furthermore, when the toner is produced by a polymerization method described later, a charge control agent can be particularly adopted which is low in polymerization inhibiting property and which includes substantially no substance soluble in an aqueous dispersing medium. Specific examples of the charge control agent include metal compounds of aromatic carboxylic acids such as salicylic acid, alkylsalicylic acid, dialkylsalicylic acid, naphthoic acid and dicarboxylic acid;

metal salts or metal complexes of azo dyes and azo pigments;

polymer type compounds having a sulfonic or carboxylic group in a side chain;

boron compounds;

urea compounds;

silicon compounds; and calixarene.

The amount of the charge control agent used is determined depending on the type of the binder resin, the presence of other additive, and a toner production method including a dispersing method, and is not unambiguously limited. When the charge control agent is internally added to the toner particle, however, the charge control agent is used in the range of 0.1 parts by mass or more and 10.0 parts by mass or less, more preferably 0.1 parts by mass or more and 5.0 parts by mass or less, based on 100 parts by mass of the binder resin. On the other hand, when the charge control agent is externally added to the toner particle, the amount thereof is preferably 0.005 parts by mass or more and 1.000 part by mass or less, more preferably 0.010 parts by mass or more and 0.300 parts by mass or less, based on 100 parts by mass of the toner.

The toner for use in the present invention may contain a release agent for the purpose of the enhancement in fixability, and the release agent is preferably contained in an amount of 1.0% by mass or more and 30.0% by mass or less, more preferably 3.0% by mass or more and 25.0% by mass or less relative to the binder resin.

If the content of the release agent is less than 1.0% by mass, a low-temperature offset suppression effect is lowered. In addition, if the content is more than 30.0% by mass, storage property for a long period is deteriorated, the charge uniformity of the toner is also deteriorated due to e.g., leaching on the toner surface, and lowing the transfer efficiency is cause and is undesirable.

The release agent that can be used for the toner for use in the present invention includes petroleum waxes such as paraffin wax, microcrystalline wax and petrolatum, and derivatives thereof; montan wax and derivatives thereof; hydrocarbon waxes by a Fischer-Tropsch process, and derivatives thereof; waxes of polyolefins typified by polyethylene, and derivatives thereof; and natural waxes such as carnauba wax and candelilla wax, and derivatives thereof, and such derivatives include oxides, block copolymers with vinyl monomers, and graft-modified products. Furthermore, higher aliphatic alcohols, fatty acids such as stearic acid and palmitic acid, acid amide waxes, ester waxes, hydrogenated castor oil and derivatives thereof, vegetable waxes, animal waxes, and the like can also be used.

In addition, the melting point of such a release agent, defined as the maximum endothermic peak temperature during temperature rise measured by differential scanning calorimeter (DSC), is preferably 60° C. or higher and 140° C. or lower, more preferably 65° C. or higher and 120° C. or lower. When the melting point is 60° C. or lower, the viscosity of the toner can be easily reduced, and fusing to the toner carrying member can be easily caused. On the other hand, when the melting point is 140° C. or higher, low temperature fixability can be easily deteriorated.

The melting point of the release agent is defined by the peak top of the endothermic peak measured by DSC. The peak top of the endothermic peak is measured according to ASTM D 3417-99. For example, DSC-7 manufactured by PerkinElmer Co., Ltd., DSC2920 manufactured by TA Instruments, or Q1000 manufactured by TA Instruments can be used for such a measurement. The temperature of an apparatus detection section is corrected using the melting points of indium and zinc, and the amount of heat is corrected using the heat of fusion of indium. The measurement is performed by using an aluminum pan for a measurement sample and installing a blank pan for control.

The toner for use in the present invention includes a magnetic member, and the amount of the magnetic member can be 20 parts by mass or more and 150 parts by mass or less based on 100 parts by mass of the binder resin.

Herein, the content of the magnetic member in the toner can be measured using a thermal analysis apparatus, TGA7 manufactured by PerkinElmer Co., Ltd. The measurement method is as follows. The toner is heated from normal temperature to 900° C. at a rate of temperature rise of 25° C./min under a nitrogen atmosphere. The reduction (% by mass) from 100° C. to 750° C. is defined as the amount of the binder resin, and the mass of the residue is approximately defined as the amount of the magnetic member.

The magnetic member mainly contains a magnetic iron oxide such as ferrosoferric oxide or y-iron oxide, and may also contain an element such as phosphorus, cobalt, nickel, copper, magnesium, manganese, aluminum or silicon. Such a magnetic member preferably has a BET specific surface area by the nitrogen adsorption method of 2 $m^2/g$ or more and 30 $m^2/g$ or less, more preferably 3 $m^2/g$ or more and 28 $m^2/g$ or less. Examples of the shape of the magnetic member include polyhedron, octahedron, hexahedron, sphericity, a needle shape and a scale shape, but a less anisotropic shape such as polyhedron, octahedron, hexahedron or sphericity can be adopted from the viewpoint of the increase in image density.

The magnetic member can have a volume average particle diameter (D3) of 0.10 μm or more and 0.40 μm or less. When the volume average particle diameter (D3) of the magnetic member falls within the above range, the dispersibility of the magnetic member can be improved and the coloring power of the toner can be enhanced.

Herein, the volume average particle diameter (D3) of the magnetic member can be measured using a transmission electron microscope. Specifically, the toner particle to be observed is sufficiently dispersed in an epoxy resin, and then the resultant is cured in an atmosphere of a temperature of 40° C. for 2 days to provide a cured product. The resulting cured product is formed into a flake-shaped sample by a microtome, and the particle diameters of 100 of the magnetic members in the field of view of a photograph are measured at a magnification of 10000 to 40000 by a transmission electron microscope (TEM). Then, the volume average particle diameter (D3) is calculated based on the corresponding diameter of a circle having an area equal to the project area of the magnetic member. The particle diameter can also be measured by an image analysis apparatus.

The magnetic member can be produced by, for example, the following method. An alkali such as sodium hydroxide in an equivalent or more to the amount of an iron component is added to an aqueous ferrous salt solution to prepare an aqueous solution including ferrous hydroxide. The oxidation reaction of ferrous hydroxide is performed while air is blown with the pH of the aqueous solution prepared being kept at 7 or more and the aqueous solution is warmed at 70° C. or higher, thereby first producing a seed crystal serving as the core of a magnetic iron oxide powder.

Then, an aqueous solution including about 1 equivalent of ferrous sulfate based on the amount of the alkali added previously is added to a slurry-like liquid including the seed crystal. The reaction of ferrous hydroxide is allowed to progress while air is blown with the pH of the liquid being kept at 5 or more and 10 or less, and a magnetic iron oxide particle is grown using the seed crystal as the core. Any pH, reaction temperature and stirring condition can be here selected to thereby control the shape and magnetic characteristics of the magnetic member. While the pH of the liquid is shifted to the acidic side as the oxidation reaction progresses, the pH of the liquid cannot be less than 5. The magnetic member thus obtained can be subjected to filtering, washing and drying by given methods to thereby provide a magnetic member.

In addition, when the toner is produced by a polymerization method in the present invention, the surface of the magnetic member can be subjected to a hydrophobization treatment. When the hydrophobization treatment is performed in a dry manner, a coupling agent is added to the magnetic member subjected to washing, filtering and drying, and the magnetic member is subjected to the hydrophobization treatment. When the hydrophobization treatment is performed in a wet manner, the magnetic member dried is re-dispersed after completion of the oxidation reaction, or an iron oxide substance obtained by washing and filtering after completion of the oxidation reaction is re-dispersed in another aqueous medium without being dried, and a coupling agent is added thereto and the magnetic member is subjected to the hydrophobization treatment. Specifically, the hydrophobization treatment is performed by adding a silane coupling agent while sufficiently stirring the re-dispersion, and raising the temperature after hydrolysis or adjusting the pH of the dispersion within an alkali region after hydrolysis. In particular, from the viewpoint that an uniform hydrophobization treatment is performed, a slurry can be formed as it is without being dried after being subjected to filtering and washing after completion of the oxidation reaction, and can be subjected to the hydrophobization treatment.

Examples of the coupling agent that can be used in the hydrophobization treatment of the magnetic member in the present invention include a silane coupling agent and a titanium coupling agent. A silane coupling agent can be used, which is represented by the following general formula (A):

$$R_mSiY_n \quad (A)$$

wherein R represents an alkoxy group, m denotes an integer of 1 or more and 3 or less, Y represents a functional group such as an alkyl group, a vinyl group, an epoxy group or a (meth)acryl group, and n denotes an integer of 1 or more and 3 or less, provided that m+n=4 is satisfied.

Examples of the silane coupling agent represented by the general formula (A) include vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane and n-octadecyltrimethoxysilane.

In particular, an alkyltrialkoxysilane coupling agent represented by the following general formula (B) can be used from the viewpoint of imparting high hydrophobicity to the magnetic member.

$$C_pH_{2p+1}—Si—(OC_qH_{2q+1})_3 \quad (B),$$

wherein p denotes an integer of 2 or more and 20 or less and q denotes an integer of 1 or more and 3 or less.

When p in the above formula denotes less than 2, it is difficult to sufficiently impart hydrophobicity to the magnetic member, and when p denotes more than 20, hydrophobicity can be sufficient, but coalescence between the magnetic members can be caused. Furthermore, when q denotes more than 3, the reactivity of the silane coupling agent is deteriorated to hardly perform hydrophobization sufficiently. Therefore, an alkyltrialkoxysilane coupling agent can be used in which, in the formula, p denotes an integer of 2 or more and 20 or less (more preferably, an integer of 3 or more and 15 or less) and q denotes an integer of 1 or more and 3 or less (more preferably, an integer of 1 or 2).

The total amount treated of the coupling agent used can be 0.9 parts by mass or more and 3.0 parts by mass or less based on 100 parts by mass of the magnetic member, and it is important that the amount of a treating agent be adjusted depending on the surface area of the magnetic member, the reactivity of the coupling agent, and the like.

In the present invention, other colorant may also be used in combination, in addition to the magnetic member. The colorant that can be used in combination includes magnetic and non-magnetic inorganic compounds, in addition to known dyes and pigments. Specifically, examples include particles of ferromagnetic metals such as cobalt and nickel, particles of alloys in which chromium, manganese, copper, zinc, aluminum, a rare-earth element, and the like are added thereto, particles of hematite and the like, titanium black, nigrosine dyes/pigments, carbon black, and phthalocyanine. Such colorants can be used with the surface thereof being subjected to the hydrophobization treatment.

The toner for use in the present invention can be produced by any known method. First, when the toner is produced by a pulverizing method, for example, the components required for the toner, such as the binder resin, the colorant and the release agent, and other additive are sufficiently mixed by a mixer such as a Henschel mixer or a ball mill. Thereafter, the resultant can be molten and kneaded using a heat kneader such as a heating roll, a kneader or an extruder to disperse or dissolve a toner material, and then subjected to cooling solidification and pulverization, followed by classification and if necessary a surface treatment, thereby providing a toner particle. Classification and surface treatment may be performed in this order or in a reverse order. In the classification step, a multi-division classifier can be used in terms of production efficiency.

The pulverization step can be performed by a method using a known pulverizing apparatus such as a mechanical impact type or jet type apparatus. In order to provide a toner having circularity suitable for use in the present invention, pulverization by additional heating, or a treatment in which a mechanical impact is supplementarily applied can be performed. A hot-water bath method in which a toner particle finely pulverized (if necessary classified) is dispersed in hot water, or a method in which a toner particle finely pulverized (if necessary classified) is allowed to pass through a thermal air current may also be used, for example.

Examples of a method for applying a mechanical impact force include a method in which a mechanical impact type pulverizing machine such as Criptron System manufactured by Kawasaki Heavy Industries Ltd. or Turbo Mill manufactured by Turbo Kogyo Co., Ltd. is used. In addition, examples include a method for applying a mechanical impact force to the toner by pressing the toner on the inner side of a casing due to a centrifugal force by a blade rotating at a high speed, as in an apparatus such as Mechanofusion System manufactured by Hosokawa Micron.

While the toner for use in the present invention can also be produced by the pulverizing method as described above, the toner particle obtained by the pulverizing method tends to be generally amorphous to have a high total energy. Then, the toner for use in the present invention is preferably produced in an aqueous medium as in a dispersion polymerization method, an association aggregation method, a dissolution suspension method, a suspension polymerization method or the like, and in particular a suspension polymerization method is very preferable because of easily imparting physical properties suitable for the present invention.

In the suspension polymerization method, a polymerizable monomer and a colorant (further, if necessary, a polymerization initiator, a crosslinking agent, a charge control agent and other additive) are uniformly dissolved or dispersed to provide a polymerizable monomer composition. Thereafter, the polymerizable monomer composition is dispersed in a continuous layer (for example, aqueous phase) containing a dispersion stabilizer by using a proper stirrer, and subjected to a polymerization reaction to thereby provide a toner having a desired particle diameter. The toner obtained by the suspension polymerization method (hereinafter, also referred to as "polymerized toner"), in which the shape of each toner particle is almost evenly spherical, can easily have a low total energy. Furthermore, such a toner can be expected to result in the increase in image quality because the distribution of the amount thereof charged is also relatively uniform.

In production of the polymerized toner in the present invention, the polymerizable monomer forming the polymerizable monomer composition includes the following.

The polymerizable monomer includes styrene type monomers such as styrene, o-methylstyrene, m-methylstyrene, p-methylstyrene, p-methoxystyrene and p-ethylstyrene; acrylates such as methyl acrylate, ethyl acrylate, n-butyl acrylate, isobutyl acrylate, n-propyl acrylate, n-octyl acrylate and dodecyl acrylate, 2-ethylhexyl acrylate, stearyl acrylate, 2-chloroethyl acrylate and phenyl acrylate, methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamide. Such monomers can be used singly or as a mixture. Among the above monomers, styrene or a styrene derivative can be used singly or can be used as a mixture with other monomer in terms of developing characteristics and durability of the toner.

The polymerization initiator for use in production of the toner for use in the present invention by a polymerization method can be a polymerization initiator whose half-life in the polymerization reaction is 0.5 hours or more and 30.0 hours or less. The polymerization reaction can be performed using the polymerization initiator in an amount added of 0.5 parts by mass or more and 20.0 parts by mass or less based on 100 parts by mass of the polymerizable monomer, thereby imparting the desired strength and proper melting characteristics to the toner.

Specific examples of the polymerization initiator include azo type or diazo type polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile, and peroxide type polymerization initiators such as benzoyl peroxide, methyl ethyl ketone peroxide, diisopropyl peroxydicarbonate, cumene hydroperoxide, 2,4-dichlorobenzoyl peroxide, lauroyl peroxide, t-butylperoxy 2-ethylhexanoate and t-butyl peroxypivalate.

When the toner for use in the present invention is produced by a polymerization method, a crosslinking agent may also be added, and the amount added can be 0.01 parts by mass or more and 5.00 parts by mass or less based on 100 parts by mass of the polymerizable monomer.

As the crosslinking agent here, a compound having two or more polymerizable double bonds can be mainly used, and examples include aromatic divinyl compounds such as divinyl benzene and divinyl naphthalene;

carboxylates having two double bonds, such as ethylene glycol diacrylate, ethylene glycol dimethacrylate and 1,3-butanediol dimethacrylate; divinyl compounds such as divinylaniline, divinyl ether, divinyl sulfide and divinyl sulfone; and compounds having three or more vinyl groups.

The compounds can be used singly or as a mixture of two or more.

In the method for producing the toner for use in the present invention by a polymerization method, in general, the polymerizable monomer composition, in which a toner composition and the like are appropriately added thereto, and uniformly dissolved or dispersed by a disperser, is suspended in an aqueous medium containing a dispersion stabilizer. Examples of the disperser include a homogenizer, a ball mill and an ultrasonic disperser, but a high-speed disperser such as a high-speed stirrer or an ultrasonic disperser is used to provide a toner particle having a desired size at once, thereby allowing the particle diameter distribution of the resulting toner particle to be sharp. The polymerization initiator may be added at the same time as addition of other additive to the polymerizable monomer, or may be added immediately before being suspended in the aqueous medium. The polymerization initiator can also be added immediately after granulation and before initiation of the polymerization reaction.

After granulation, stirring may be performed using a usual stirrer so that the resulting particle is maintained in the form thereof and is prevented from floating and settling.

When the toner for use in the present invention is produced, a known surfactant, organic dispersant or inorganic dispersant can be used as the dispersion stabilizer. In particular, an inorganic dispersant can be used because of hardly providing a harmful ultrafine particle and achieving dispersion stability due to the steric barrier property thereof. Examples of such an inorganic dispersant include phosphate multivalent metal salts such as tricalcium phosphate, magnesium phosphate, aluminum phosphate, zinc phosphate and hydroxyapatite, and carbonates such as calcium carbonate and magnesium carbonate, inorganic salts such as calcium metasilicate, calcium sulfate and barium sulfate, and inorganic compounds such as calcium hydroxide, magnesium hydroxide and aluminum hydroxide.

Such an inorganic dispersant can be used in an amount of 0.2 parts by mass or more and 20.0 parts by mass or less based on 100 parts by mass of the polymerizable monomer. The dispersion stabilizer may be used singly or in combination of two or more. A surfactant may be further used in combination.

In the step of polymerizing the polymerizable monomer, the polymerization temperature is set at a temperature of 40° C. or higher, generally 50° C. or higher and 90° C. or lower. If the polymerization is performed in the temperature range, the release agent to be incorporated inside is precipitated by phase separation to be more completely enclosed.

After completion of the polymerization of the polymerizable monomer, the resulting polymer particle is subjected to filtering, washing and drying by a known method to provide a toner particle. An inorganic fine particle described later can be, if necessary, mixed with the toner particle and attached to the surface of the toner particle, thereby providing the toner for use in the present invention. The classification step can also be inserted to the production step (before mixing of the inorganic fine particle) to remove a coarse powder and a fine powder included in the toner particle.

The toner for use in the present invention, as described above, contains the first fine silica particle having a number average primary particle diameter (D1) of 5 nm or more and 20 nm or less, and the second fine silica particle having a number average primary particle diameter (D1) of 40 nm or more and 200 nm or less.

The first fine silica particle can be made of fumed silica, which is subjected to a hydrophobization treatment with 15.0 parts by mass or more and 40.0 parts by mass or less of a silicone oil based on 100 parts by mass of the silica raw material. With respect to the degree of the hydrophobization treatment, the degree of hydrophobization measured by a methanol titration test is preferably 70% or more, more preferably 80% or more, from the viewpoint of suppression of the deterioration in chargeability in a high-temperature and high-humidity environment.

Examples of the silicone oil includes a dimethylsilicone oil, a methylphenylsilicone oil, an α-methylstyrene-modified silicone oil, a chlorophenylsilicone oil and a fluorine-modified silicone oil.

In the present invention, the kinematic viscosity of the silicone oil for use in the treatment of the first fine silica particle at 25° C. is preferably 30 $mm^2/s$ or more and 500 $mm^2/s$ or less. When the kinematic viscosity falls within the above range, uniformity is easily controlled in the hydrophobization treatment of the silica raw material with the silicone oil. Furthermore, the kinematic viscosity of the silicone oil is closely related to the molecular chain length of the silicone oil, and when the kinematic viscosity falls within the above range, the degree of aggregation of the fine silica particle can be easily controlled within a suitable range. The kinematic viscosity of the silicone oil at 25° C. is more preferably in the range of 40 $mm^2/s$ or more and 300 $mm^2/s$ or less. The apparatus for measuring the kinematic viscosity of the silicone oil includes a capillary kinematic viscometer (manufactured by Kaburagi Scientific Instruments Industry Co., Ltd.) and a fully-automatic micro-kinematic viscometer (manufactured by Viscotech Co., Ltd.).

The first fine silica particle for use in the present invention can be obtained by treating the silica raw material with the silicone oil and then with at least one of alkoxysilane and silazane. Thus, the silica raw material surface that has not been able to be subjected to the hydrophobization treatment with the silicone oil can be subjected to the hydrophobization treatment, and thus a fine silica particle having a high degree of hydrophobization can be stably obtained. Furthermore, such a fine silica particle can form less aggregate to thereby have an enhanced fluidity, resulting in a significant improvement in releasability of the toner.

The first fine silica particle for use in the present invention may be subjected to a cracking treatment during or after the above treatment step. When a two-step treatment is performed, the cracking treatment can also be performed during the two steps.

The surface treatment of the silica raw material with the silicone oil, and the surface treatment thereof with alkoxysilane and silazane may be a dry treatment or a wet treatment.

In a specific procedure of the surface treatment of the silica raw material with the silicone oil, for example, the fine silica particle is loaded in a solvent in which the silicone oil is dissolved (the solvent can be adjusted to have a pH of 4 by an organic acid or the like) and reacted, and thereafter the solvent is removed. Thereafter, the cracking treatment may be performed.

When the surface treatment with at least one of alkoxysilane and silazane is subsequently performed, a specific procedure is as follows. The fine silica particle cracked and subjected to the treatment with the silicone oil is loaded in a solvent in which at least one of alkoxysilane and silazane is dissolved, and reacted, thereafter, the solvent is removed, and the cracking treatment is performed. The following method may also be adopted. For example, in the surface treatment with the silicone oil, the fine silica particle is loaded in a reaction tank. Then, an alcohol-water mixture is added thereto with stirring under a nitrogen atmosphere, the silicone oil is introduced to the reaction tank, the surface treatment is performed, the resultant is heated and stirred to remove the solvent, and the cracking treatment is performed. In the surface treatment with at least one of alkoxysilane and silazane, at least one of alkoxysilane and silazane is introduced with stirring under a nitrogen atmosphere, the surface treatment is performed, and the resultant is further heated and stirred to remove the solvent, followed by cooling.

As the alkoxysilane, methyltrimethoxysilane, dimethyldimethoxysilane, phenyltrimethoxysilane, methyltriethoxysilane, dimethyldiethoxysilane and phenyltriethoxysilane can be suitably exemplified. On the other hand, as the silazane, hexamethyldisilazane can be suitably exemplified.

The amount treated with at least one of such alkoxysilane and silazane is 0.1 parts by mass or more and 20.0 parts by mass or less based on 100 parts by mass of the silica raw material, as the total amount of at least one of such alkoxysilane and silazane.

The rate of immobilization of the silicone oil on the first fine silica particle on carbon basis can be 90% or more. Herein, the rate of immobilization of the silicone oil based on the amount of carbon corresponds to the amount of a silicone oil molecule chemically bound to the surface of the silica raw material.

In order that the rate of immobilization of the silicone oil on the first fine silica particle based on the amount of carbon is increased, the silicone oil is required to be chemically immobilized on the surface of the silica raw material in the process of providing the fine silica particle. For the purpose, a method can be suitably exemplified in which a heating treatment is performed for the reaction of the silicone oil in the process of providing the fine silica particle. The heating treatment temperature can be 100° C. or higher, and as the heating treatment temperature is higher, the rate of immobilization can be increased. The heating treatment step can be performed immediately after the treatment with the silicone oil is performed, but, if the cracking treatment is performed, the heating treatment step may also be performed after the cracking treatment step.

In the present invention, the amount of the first fine silica particle added is preferably 0.2 parts by mass or more and 3.0 parts by mass or less, more preferably 0.2 parts by mass or more and 2.0 parts by mass or less, based on 100 parts by mass of the magnetic toner particle. When the amount of the first fine silica particle added falls within the above range, fluidity favorable for a magnetic toner can be imparted, and fixability cannot also be inhibited.

Then, the toner carrying member for use in the present invention is described.

The toner carrying member for use in the present invention has a substrate, an elastic layer and a surface layer including a urethane resin, and the urethane resin has a partial structure derived from a reaction of the compound represented by the structural formula (1) with a polyisocyanate.

One embodiment of the toner carrying member in the present invention is illustrated in FIG. 1. In a conductive roller 1 (toner carrying member) illustrated in FIG. 1, an elastic layer 3 is formed on the outer periphery of a columnar or hollow cylindrical conductive substrate 2. In addition, the outer periphery of the elastic layer 3 is covered with a surface layer 4.

<Substrate>

The substrate 2 functions as an electrode and a supporting member of the conductive roller 1, and is formed of a conductive material, for example, a metal or an alloy such as aluminum, a copper alloy or stainless steel; iron plated with chromium or nickel; or a synthetic resin having conductivity.

<Elastic Layer>

The elastic layer 3 imparts to the conductive roller, elasticity required for forming an abutment portion between the conductive roller and an electrostatic latent image bearing member in a predetermined width of the abutment portion.

The elastic layer 3 can be usually formed by a molded product of a rubber material. The rubber material includes the following: an ethylene-propylene-diene copolymerized rubber (EPDM), an acrylonitrile-butadiene rubber (NBR), a chloroprene rubber (CR), a natural rubber (NR), an isoprene rubber (IR), a styrene-butadiene rubber (SBR), a fluorine rubber, a silicone rubber, an epichlorohydrin rubber, a hydrogenated product of NBR and a urethane rubber. The materials can be used singly or as a mixture of two or more.

In particular, a silicone rubber can be adopted which hardly causes compression set on the elastic layer even if abutting with other member (developer-regulating blade or the like) over a long period. The silicone rubber includes a cured product of an addition-curable silicone rubber. More specifically, a cured product of an addition-curable dimethylsilicone rubber can be particularly adopted because of being excellent in adhesiveness with a surface layer described later.

Various additives such as a conductivity-imparting agent, a non-conductive filler, a crosslinking agent and a catalyst are appropriately compounded in the elastic layer 3. As the conductivity-imparting agent, a fine particle of carbon black; a fine particle of a conductive metal such as aluminum or copper; or a fine particle of a conductive metal oxide such as zinc oxide, tin oxide or titanium oxide can be used. In particular, carbon black can be adopted because of being relatively easily available and imparting good conductivity. When being used as the conductivity-imparting agent, carbon black is compounded in an amount of 2 to 50 parts by mass based on 100 parts by mass of the rubber in the rubber material. The non-conductive filler includes silica, a quartz powder, titanium oxide, zinc oxide and calcium carbonate. The crosslinking agent includes di-t-butylperoxide, 2,5-dimethyl-2,5-di(t-butylperoxy)hexane and dicumyl peroxide. The catalyst includes a known catalyst commonly used.

<Surface Layer>

The surface layer 4 is a resin layer mainly including a urethane resin, and the urethane resin is obtained by the reaction of a polyol with a polyisocyanate and can be synthesized as follows.

First, a polyol component such as a polyether polyol or a polyester polyol is reacted with a polyisocyanate to provide an isocyanate group-terminal prepolymer.

Then, the isocyanate group-terminal prepolymer can be reacted with a compound having a structure of structural formula (1) to thereby provide the urethane resin in the present invention.

The polyether polyol includes polyethylene glycol, polypropylene glycol and polytetramethylene glycol. The polyester polyol includes a polyester polyol obtained by a condensation reaction of a diol component such as 1,4-butanediol, 3-methyl-1,4-pentanediol or neopentyl glycol, or a triol component such as trimethylolpropane with a dicarboxylic acid such as adipic acid, phthalic anhydride, terephthalic acid or hexahydroxyphthalic acid.

In addition to the above, examples include a polyolefin polyol such as polybutadiene polyol and polyisoprene polyol, or a hydrogenated additive thereof, and a polycarbonate polyol.

Such a polyol component may be a prepolymer in which the chain is, as necessary, elongated by an isocyanate such as 2,4-tolylene diisocyanate (TDI), 1,4-diphenylmethane diisocyanate (MDI) or isophorone diisocyanate (IPDI) in advance.

The number average molecular weight of each of the polyether polyol and the polyester polyol can be particularly 1000 or more and 4000 or less. When the number average molecular weight of the polyol falls within the above range, the polyol exhibits a high reactivity with an isocyanate because of having a large number of hydroxyl groups relative to the molecular weight, and the chargeability under a high-temperature and high-humidity environment is improved because the unreacted component is decreased.

The isocyanate compound to be reacted with such a polyol component and the compound represented by structural formula (1) is not particularly limited, but an aliphatic polyisocyanate such as ethylene diisocyanate or 1,6-hexamethylene diisocyanate (HDI), an alicyclic polyisocyanate such as isophorone diisocyanate (IPDI), cyclohexane 1,3-diisocyanate or cyclohexane 1,4-diisocyanate, an aromatic isocyanate such as 2,4-tolylene diisocyanate, 2,6-tolylene diisocyanate (TDI), 4,4'-diphenylmethane diisocyanate (MDI), polymeric diphenylmethane diisocyanate, xylylene diisocyanate or naphthalene diisocyanate, and a copolymerized product, an isocyanurate product, a TMP adduct product, a biuret product and a block product thereof can be used.

In particular, an aromatic isocyanate such as tolylene diisocyanate, diphenylmethane diisocyanate or a polymeric diphenylmethane diisocyanate is more suitably used.

With respect to the mixing ratio of the isocyanate compound to be reacted with the polyol component and the compound represented by structural formula (1), the rate of an isocyanate group to 1.0 of each hydroxyl group can be in the range from 1.0 to 2.0.

While the toner carrying member for use in the present invention has the compound represented by structural formula (1) in the surface layer, as described above, such a compound can be used to thereby allow the toner to keep good rolling property and impart high chargeability to the toner.

Structural formula (1)

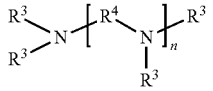

The compound represented by structural formula (1) is described in detail. The compound represented by structural formula (1) represents a polyfunctional polyol having an amino structure in the molecule or a terminal amino compound. When n denotes an integer of 1 or more and 4 or less, namely, the compound has a structure having 4 or more and 7 or less hydroxyl groups or amino groups which are reactive functional groups, a crosslinking structure by a urethane group or a urea group can be formed well to result in the enhancement in microhardness. As a result, the toner can keep good rolling property.

Then, according to studies by the present inventors, the present effect is exerted when the number of hydroxyl groups or amino groups in the compound represented by structural formula (1) is 4 or more and 7 or less. Therefore, the number of terminal functional groups in the compound represented by structural formula (1) may be at least 4, and, even if the residue is substituted with an alkyl group, the same effect is exerted.

In the compound represented by structural formula (1), each $R^3$ independently represents any selected from the group consisting of the following (a) to (c):

(a) a hydroxyalkyl group having 2 or more and 8 or less carbon atoms;

(b) an aminoalkyl group having 2 or more and 8 or less carbon atoms; and (c) a group represented by structural formula (2).

When $R^3$ represents a hydroxyalkyl group, the number of carbon atoms is 1 or more and 8 or less carbon atoms, and when $R^3$ represents an aminoalkyl group, the number of carbon atoms is 2 or more and 8 or less carbon atoms, and thus the crosslinking structure by a urethane or urea group can be easily formed.

The structural formula (2) represents a group in which the terminal having a so-called ether repeating unit is a hydroxyl group. Even when $R^3$ represents the group represented by structural formula (2), $R^5$ can represent an alkylene group having 2 or more and 5 or less carbon atoms, and the number of ether repeating units, m, can be 2 or more and 3 or less from the same reason.

Structural formula (2)

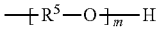

In the structural formula (1), $R^4$ can represent an alkylene group having 2 or more and 4 or less carbon atoms. When $R^4$ represents an alkylene group having 2 or more and 4 or less carbon atoms, the chargeability of the toner carrying member is enhanced. The reason for this is considered because $R^4$ represents an alkylene group having 2 or more and 4 or less carbon atoms to thereby have a proper size as a molecule, resulting in good dispersibility in the reaction with an isocyanate.

With respect to the compound represented by structural formula (1), a compound represented by structural formula (3) can be adopted. That is, in the compound represented by structural formula (1), n can denote an integer of 1 or 2, each $R^3$ can independently represent an alkylene group having 2 or 3 carbon atoms, and $R^4$ can represent an alkylene group having 2 carbon atoms.

The urethane resin including the partial structure derived from structural formula (3), which has a functionality of 5, can be particularly adopted because the distance between urethane groups falls within the most suitable range and thus the rolling property of the toner at the regulating part is good.

Structural formula (3)

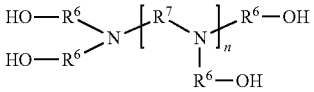

In the structural formula (3), n denotes an integer of 1 or 2, each $R^6$ independently represents an alkylene group having 2 or 3 carbon atoms, and $R^7$ represents an alkylene group having 2 carbon atoms.

Herein, in the present invention, the structure formed by the reaction of the compound represented by structural formula (1) with a polyisocyanate is as follows.

When $R^3$ represents (a) the hydroxyalkyl group having 2 or more and 8 or less carbon atoms, or $R^3$ represents (c) the group represented by the structural formula (2), a structure having a urethane group at the terminal of the structural formula (1) is formed.

In addition, when $R^3$ represents (b) the aminoalkyl group having 1 or more and 8 or less carbon atoms, a structure having a urea group at the terminal of the structural formula (1) is formed.

The surface layer 4 can have conductivity. A measure for imparting conductivity includes addition of an ion-conductive agent or a conductive fine particle, but a conductive fine particle that is inexpensive and small in environmental variation can be used, and carbon black can be particularly adopted in terms of conductivity imparting property and reinforcing property. With respect to properties of the conductive fine particle, when the conductive fine particle is carbon black having a primary particle diameter of 18 nm or more and 50 nm or less and having an amount of DBP oil absorption of 50 ml/100 g or more and 160 ml/100 g or less, conductivity, hardness and dispersibility can be well-balanced. The content of the conductive fine particle can be 10% by mass or more and 30% by mass or less based on 100 parts by mass of the resin component forming the surface layer.

When the toner carrying member is required to have a roughened surface, a fine particle for roughness control may also be added to the surface layer 4. The fine particle for roughness control can have a volume average particle diameter (D3) of 3 μm or more and 20 μm or less. The amount of the particle added to the surface layer can be 1 part by mass or more and 50 parts by mass or less based on 100 parts by mass of the solid content of the resin in the surface layer. As the fine particle for roughness control, a fine particle of a polyurethane resin, a polyester resin, a polyether resin, a polyamide resin, an acrylic resin or a phenol resin can be used.

The method for forming the surface layer 4 is not particularly limited, but includes spraying, dipping or roll coating by a coating material. The dip coating method described in Japanese Patent Application Laid-Open No. 57-5047, in which a coating material is allowed to overflow from the upper end of a dipping tank, is simple and excellent in production stability as the method for forming the surface layer.

Then, the developing apparatus of the present invention is more specifically described with reference to the drawings, but the present invention is not limited thereto.

Figure 2:
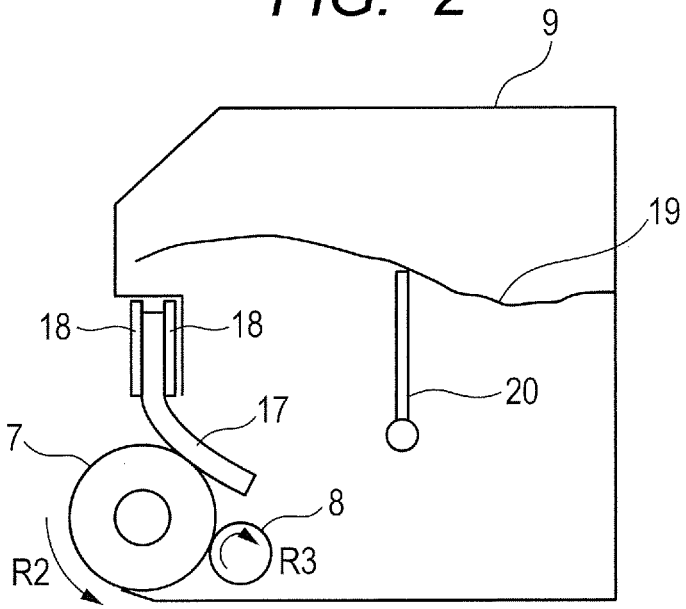
FIG. 2 is a schematic cross-sectional view illustrating one example of a developing apparatus according to the present invention.
Figure 3:
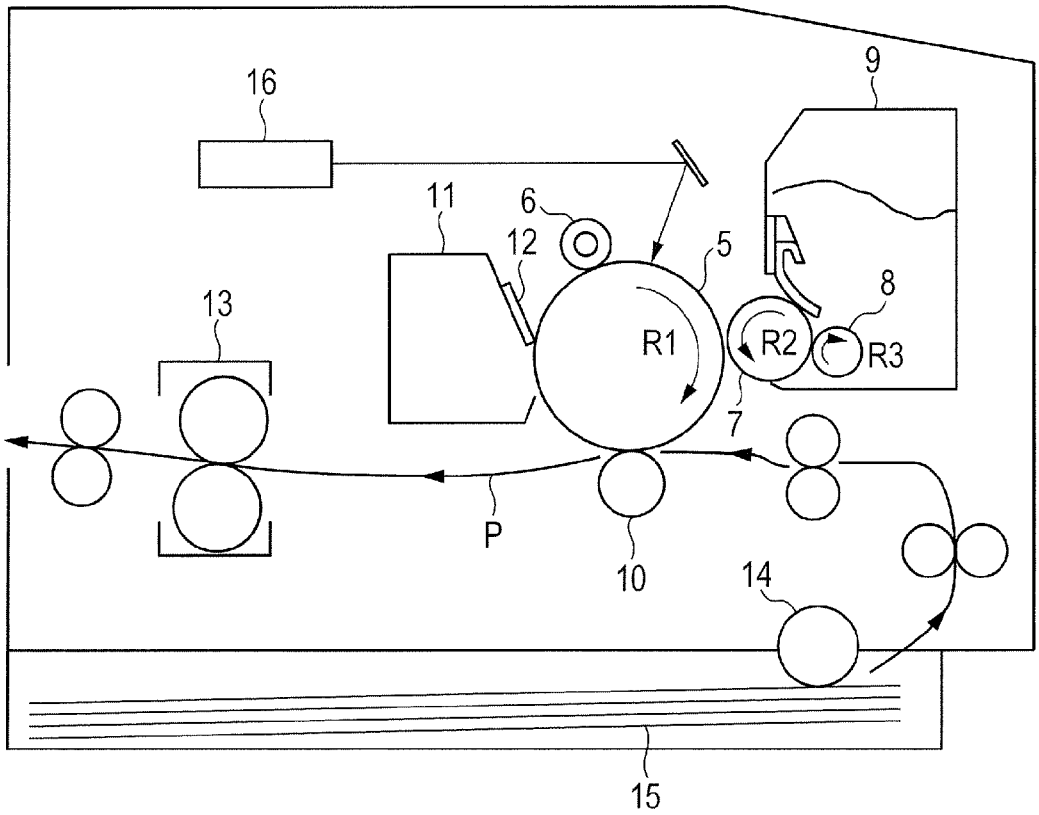
FIG. 3 is a schematic cross-sectional view illustrating one example of an image forming apparatus having the developing apparatus according to the present invention.

FIG. 2 is a schematic cross-sectional view illustrating one example of the developing apparatus of the present invention. FIG. 3 is a schematic cross-sectional view illustrating one example of an image forming apparatus into which the developing apparatus of the present invention is incorporated.

In FIG. 2 or FIG. 3, an electrostatic latent image bearing member 5, which is an image carrying member on which an electrostatic latent image is formed, is rotated in the direction of arrow R1. A toner carrying member 7 is rotated in the direction of arrow R2 to thereby convey a toner 19 to a development region in which the toner carrying member 7 is opposite to the electrostatic latent image bearing member 5. A toner supply member 8 is in contact with the toner carrying member, and is rotated in the direction of arrow R3 to thereby supply the toner 19 to the surface of the toner carrying member.

A charging roller 6, a transfer member (transfer roller) 10, a cleaner vessel 11, a cleaning blade 12, a fixing unit 13, a pick-up roller 14 and the like are provided around the electrostatic latent image bearing member 5. The electrostatic latent image bearing member 5 is charged by the charging roller 6. Then, the electrostatic latent image bearing member 5 is irradiated with laser light, which is light for image exposure, by a laser generation apparatus 16 to thereby perform image exposure, forming an electrostatic latent image corresponding to an intended image. The electrostatic latent image on the electrostatic latent image bearing member 5 is developed by a toner in a developing unit 9, to provide a toner image. The toner image is transferred onto a transfer material (paper) 15 by the transfer member (transfer roller) 10 abutting with the electrostatic latent image bearing member 5 with the transfer material interposed therebetween. The transfer of the toner image from the electrostatic latent image bearing member onto the transfer material may also be performed via an intermediate transfer member. The transfer material (paper) 15 on which the toner image is placed is conveyed to the fixing unit 13, and the toner image is fixed on the transfer material (paper) 15. In addition, the toner 19 partially remaining on the electrostatic latent image bearing member 5 is scraped off by the cleaning blade 12, and accommodated in the cleaner vessel 11.

In a charging step in the developing apparatus of the present invention, a contact charging apparatus can be used in which an electrostatic latent image bearing member is in contact with a charging roller with forming an abutment portion and a predetermined charging bias is applied to the charging roller to charge the surface of the electrostatic latent image bearing member at predetermined polarity and potential. Contact charging can be thus performed to thereby perform stable and uniform charging and also to decrease the generation of ozone. In order to keep the contact with the electrostatic latent image bearing member uniform and perform uniform charging, a charging roller that rotates in the same direction as the rotating direction of the electrostatic latent image bearing member can be used.

Process conditions in use of the charging roller can be, for example, as follows. The abutment pressure of the charging roller can be modulated within the range of 4.9 N/m or more and 490.0 N/m or less, and the voltage can be a direct voltage or a voltage of a direct voltage superimposed with an alternating voltage.

The alternating voltage can be 0.5 kVpp or more and 5.0 kVpp or less, the alternating frequency can be 50 Hz or more and 5 kHz or less, and the absolute value of the voltage as a direct voltage can be 400 V or more and 1700 V or less.

The material of the charging roller includes a rubber material in which a conductive substance such as carbon black and a metal oxide is dispersed in an elastic member for resistivity adjustment, and a foamed member thereof, but not limited thereto. Examples of the material of the elastic member include ethylene-propylene-dienepolyethylene (EPDM), urethane, a butadieneacrylonitrile rubber (NBR), a silicone rubber and an isoprene rubber. In addition, resistivity can also be adjusted using an ion-conductive material without the conductive substance dispersed or in combination with the conductive substance.

In addition, a core metal for use in the charging roller includes aluminum and SUS. The charging roller is disposed in contact with an object to be charged as the electrostatic latent image bearing member by pressing at a predetermined pressing force against elasticity, to form a charging abutment portion as the abutment portion between the charging roller and the electrostatic latent image bearing member.

Then, a contact transfer step that can be applied in the developing apparatus of the present invention is specifically described. The contact transfer step is for electrostatically transferring the toner image to a recording medium while the electrostatic latent image bearing member abuts with a transfer member, to which a voltage having an opposite polarity to the polarity of the toner is applied, with the recording medium interposed therebetween. The abutment pressure of the transfer member is preferably 2.9 N/m or more, more preferably 19.6 N/m or more, as a linear pressure. When the linear pressure as the abutment pressure is less than 2.9 N/m, conveyance deviation and transfer failure of the recording medium are easily caused.

In the present invention, the toner regulating member can abut with the toner carrying member with the toner interposed therebetween to thereby regulate the thickness of the toner layer on the toner carrying member. Thus, a high image quality with no fogging can be achieved. The toner regulating member that abuts with the toner carrying member is generally a regulating blade, which can also be suitably used in the present invention.

As the regulating blade, an elastic rubber member such as a silicone rubber, a urethane rubber or NBR; an elastic member of a synthetic resin such as polyethylene terephthalate, or a metal elastic member such as a phosphor-bronze plate or a SUS plate can be used, and a composite thereof can also be used. Furthermore, a blade may also be used in which a charge control substance such as a resin, a rubber, a metal oxide or a metal is applied to an elastic support such as a rubber, a synthetic resin or a metal elastic member so as to touch to the abutment portion with the toner carrying member, for the purpose of controlling the chargeability of the toner. In particular, the resin or rubber can be pasted to the metal elastic member so as to touch to the abutment portion with the toner carrying member.

The material of the member to be pasted to the metal elastic member can be a material that is easily charged at a positive polarity, such as a urethane rubber, a urethane resin, a polyamide resin or a nylon resin.

The upper side portion of the regulating blade, namely, a base portion, is secured and held facing the developing unit, and the lower side portion thereof is allowed to abut with the surface of the toner carrying member by a proper elastically pressing force in the state of being deflected against the elastic force of the blade in the forward or opposite direction of the toner carrying member.

The abutment pressure between the regulating blade and the toner carrying member, as the linear pressure in the bus bar direction of the toner carrying member, is preferably 1.30 N/m or more and 245.0 N/m or less, further preferably 4.9 N/m or more and 118.0 N/m or less. When the abutment pressure is less than 1.30 N/m, it is difficult to uniformly apply the toner, and fogging or spreading is easily caused. When the abutment pressure is more than 245.0 N/m, a high pressure is applied to the toner, and the toner tends to be easily degraded.

The amount of the toner on the toner carrying member is preferably 2.0 $g/m^2$ or more and 15.0 $g/m^2$ or less, more preferably 3.0 $g/m^2$ or more and 14.0 $g/m^2$ or less. When the amount of the toner on the toner carrying member is less than 2.0 $g/m^2$, a sufficient image density is hardly achieved.

On the other hand, when the amount of the toner on the toner carrying member is more than 15.0 $g/m^2$, the regulation failure is easily caused, and uniform chargeability is easily lost and thus the increase in fogging tends to be caused.

In the present invention, the amount of the toner on the toner carrying member can be arbitrarily changed by changing the surface roughness (Ra) of the toner carrying member, the free length of the regulating blade, and the abutment pressure of the regulating blade.

The amount of the toner on the toner carrying member is measured as follows: a cylindrical paper filter is set to a suction port having an outer diameter of 6.5 mm; the suction port is mounted to a vacuum, the toner on the toner carrying member is sucked under vacuuming, the amount (g) of the toner sucked is divided by the area ($m^2$) where the toner is sucked, to provide a value, and the value is defined as the amount of the toner on the toner carrying member.

In the present invention, the outer diameter of the toner carrying member that carries the toner can be 8.0 mm or more and 14.0 mm or less. The outer diameter of the toner carrying member can be smaller from the viewpoint of making the developing apparatus compact, but, when the outer diameter is smaller, developing property is more easily deteriorated, and also fogging tends to be less suppressed. Therefore, with respect to the toner carrying member and the toner for use in the present invention, the outer diameter of the toner carrying member can be 8.0 mm or more and 14.0 mm or less in order that the developing apparatus is made compact and at the same time fogging is suppressed.

The surface roughness of the toner carrying member for use in the present invention is preferably in the range of 0.3 μm or more and 5.0 μm or less, more preferably 0.5 μm or more and 4.5 μm or less, as the center line average roughness Ra according to the standard of surface roughness prescribed in JIS B 0601:1994.

When the Ra falls within the range of 0.3 μm or more and 5.0 μm or less, a sufficient amount of conveyance of the toner is achieved and the amount of the toner on the toner carrying member is easily regulated, and the regulation failure is hardly caused and the amount of the toner charged is easily uniform.

Measurement of the center line average roughness Ra of the surface of the toner carrying member, according to the standard of surface roughness prescribed in JIS B 0601:1994, is performed using Surfcorder SE-3500 manufactured by Kosaka Laboratory Ltd. The measurement is performed at nine points (three points in the circumferential direction with respect to each of three points at regular intervals in the axis direction) under conditions of a cutoff value of 0.8 mm, an evaluation length of 4 mm and a feeding speed of 0.5 mm/s, and the average of the nine values is determined.

The surface roughness of the toner carrying member in the present invention can fall within the above range by, for example, changing the polishing state of the surface layer of the toner carrying member, or adding a spherical carbon particle, a carbon fine particle, graphite, a resin fine particle or the like.

In the present invention, the developing step can be a step of applying a developing bias to the toner carrying member to transfer the toner to the electrostatic latent image on the electrostatic latent image bearing member, forming the toner image, and the developing bias to be applied may be a direct voltage or a voltage in which a direct voltage is superimposed with an alternating electric field.

As the waveform of the alternating electric field, sine wave, rectangular wave, triangular wave or the like can be appropriately used. Alternatively, pulse wave formed by periodically turning a direct-current power supply on/off may be used. Thus, as the waveform of the alternating electric field, a bias whose voltage value is periodically changed can be used.

Figure 4:
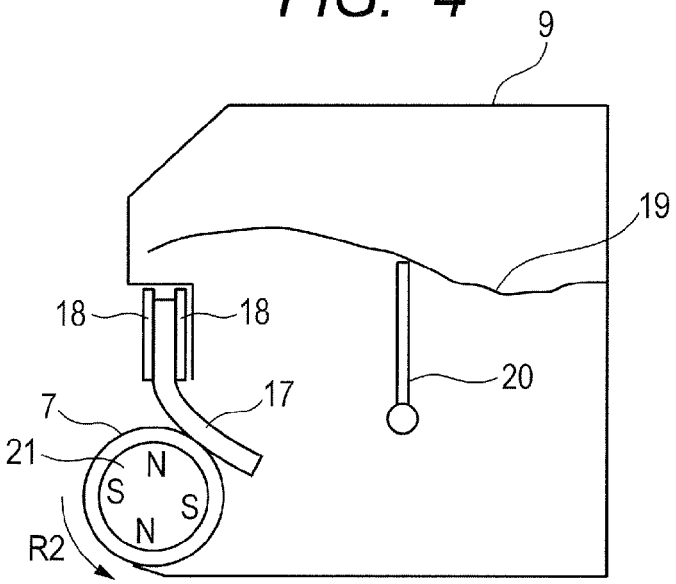
FIG. 4 is a schematic cross-sectional view illustrating one example of the developing apparatus according to the present invention.

When a system in which the toner is magnetically conveyed using no toner supply member is used in the present invention, a magnet is required to be arranged in the toner carrying member (reference numeral 21 in FIG. 4). In such a case, the toner carrying member can have a immobilized magnet having multipole therein, and can have 3 or more and 10 or less magnetic poles.

Then, measurement methods of respective physical properties according to the toner for use in the present invention are described.

<Average particle diameter and particle size distribution of magnetic toner>

The weight average particle diameter (D4) of the toner is calculated as follows. As the measuring apparatus, a precision particle size distribution measuring apparatus based on a pore electric resistance method, provided with a 100-μm aperture tube, "Coulter Counter Multisizer 3" (registered trademark, manufactured by Beckman Coulter Inc.) is used. A dedicated software included therein "Beckman Coulter Multisizer 3 Version 3.51" (manufactured by Beckman Coulter Inc.) is used for setting measurement conditions and analyzing measurement data. Herein, the measurement is performed with a number of effective measurement channels of 25000.

An aqueous electrolytic solution for use in the measurement, which is prepared by dissolving special grade sodium chloride in ion-exchange water so as to have a concentration of about 1% by mass, for example, "ISOTON II" (manufactured by Beckman Coulter Inc.) can be used.

Herein, the dedicated software is set as described below prior to the measurement and analysis.

In the screen "change standard operating method (SOM)" of the dedicated software, the total count number of a control mode is set to 50000 particles, the number of measurements is set to 1, and a value obtained by using a "standard particle having a diameter of 10.0 μm" (manufactured by Beckman Coulter Inc.) is set as the Kd value. The threshold and the noise level are automatically set by clicking a "Threshold/noise level measurement button". In addition, the current is set to 1600 μA, the gain is set to 2, the electrolytic solution is set to ISOTON II, and a check mark is placed in "Flush aperture tube after measurement".

In the screen "setting of conversion from pulse to particle diameter" of the dedicated software, a bin space is set to a logarithmic particle diameter, the number of particle diameter bins is set to 256, and the particle diameter range is set to the range from 2 μm to 60 μm.

A specific measurement method is as follows.

(1) About 200 ml of the aqueous electrolytic solution is placed in a 250-ml round-bottom beaker made of glass, dedicated for the Multisizer 3, the beaker is set on a sample stand, and stirring with a stirrer rod is performed at 24 rotations/sec in the counterclockwise direction. Then, dirt and bubbles in the aperture tube are removed by the "Flush aperture" function of the dedicated software.

(2) About 30 ml of the aqueous electrolytic solution is placed in a 100-ml flat-bottom beaker made of glass. About 0.3 ml of a diluted solution prepared by diluting "Contaminon N" (10% by mass aqueous solution of a neutral detergent for washing a precision measuring unit, including a nonionic surfactant, an anionic surfactant and an organic builder and having a pH of 7, produced by Wako Pure Chemical Industries, Ltd.) with ion-exchange water by about three-fold by mass is added as a dispersant to the aqueous electrolytic solution.

(3) An ultrasonic dispersing unit "Ultrasonic Dispersion System Tetora 150" (manufactured by Nikkaki Bios Co., Ltd.) in which two oscillators each having an oscillatory frequency of 50 kHz are built so as to be out of phase by 180 degrees and which has an electrical output of 120 W is prepared. About 3.3 1 of ion-exchange water is placed in the water tank of the ultrasonic dispersing unit, and about 2 ml of Contaminon N is added into the water tank.

(4) The beaker in (2) is set in the beaker fixing hole of the ultrasonic dispersing unit, and the ultrasonic dispersing unit is operated. Then, the height position of the beaker is adjusted so that the liquid level of the aqueous electrolytic solution in the beaker resonates to the maximum extent.

(5) About 10 mg of the toner is added to the aqueous electrolytic solution in small portions and dispersed therein with the aqueous electrolytic solution in the beaker in (4) being irradiated with ultrasonic wave. Then, the ultrasonic dispersion treatment is continued for additional 60 seconds. Herein, the temperature of water in the water tank is appropriately adjusted so as to be 10° C. or higher and 40° C. or lower during ultrasonic dispersion.

(6) The aqueous electrolytic solution in (5) in which the toner is dispersed is dropped using a pipette to the round-bottom beaker in (1) disposed in the sample stand, and the concentration measured is adjusted to about 5%. Then, the measurement is performed until the number of particles measured reaches 50000.

(7) The measurement data is analyzed by the dedicated software included in the apparatus, and the weight average particle diameter (D4) is calculated. Herein, the "Average diameter" in the screen "Analysis/volume statistics (arithmetic average)" of the dedicated software in setting the dedicated software to graph/% by volume is the weight average particle diameter (D4).

<Measurement Method of Number Average Primary Particle Diameter (D1) of Fine Silica Particle>

The number average primary particle diameter (D1) of the fine silica particle is calculated using the image of the fine silica particle on the toner surface, taken by Hitachi ultrahigh resolution field emission scanning electron microscope S-4800 (Hitachi High-Technologies Corporation). The image-taking conditions of S-4800 are as follows.

(1) Preparation of Specimen

A specimen stage (aluminum specimen stage: 15 mm x 6 mm) is thinly coated with a conductive paste, and the toner is blown thereon. The specimen stage is further air-blown to remove the excessive toner therefrom, and sufficiently dried. The specimen stage is set to a specimen holder, and the height of the specimen stage is modulated to 36 mm by a specimen-height gage.

(2) Setting of S-4800 Observation Conditions

The number average primary particle diameter (D1) of the fine silica particle is calculated using an image obtained by backscattered electron image observation by 5-4800. In the backscattered electron image, charge-up of the fine silica particle is less caused than the case of a secondary electron image, and thus the particle diameter of the fine silica particle can be precisely measured.

Liquid nitrogen is poured into an anti-contamination trap mounted to a lens tube of S-4800 until liquid nitrogen overflows, and is left for 30 minutes. "PCSTEM" of S-4800 is started to perform flashing (cleaning of FE tip as an electron source). The acceleration voltage display portion of the control panel on the screen is clicked, the "Flashing" button is pressed, and the flashing execution dialog is opened. The flashing intensity is confirmed to be 2, and flashing is executed. The emission current by flashing is confirmed to be 20 to 40 μA. The specimen holder is inserted to a specimen chamber of the lens tube of S-4800. "Home" on the control panel is pressed, and the specimen holder is moved to the examination position.

The acceleration voltage display portion is clicked to open the HV setting dialog, and the acceleration voltage is set to "0.8 kV" and the emission current is set to "20 μA". Within the "Basic" tab of the operation panel, the signal selection is set to "SE", SE detectors are selected as "Upper (U)" and "+BSE", and "L.A. 100" is selected in the selection box at the right of "+BSE" to thereby set the microscope in the mode for observation in a backscattered electron image. Also within the "Basic" tab in the operation panel, the probe current in the block of electron optics conditions is set to "Normal", and the focus mode is set to "UHR", and WD to "3.0 mm". The "ON" button of the acceleration voltage display portion on the control panel is pressed to apply the acceleration voltage.

(3) Calculation of Number Average Particle Diameter (D1) of Fine Silica Particle The magnification indicator area on the control panel is dragged and the magnification is set to 100000 (100 k). The "Coarse" focus knob on the operation panel is rotated, and once the image is more or less in focus, adjustment of the aperture alignment is performed. "Align" in the control panel is clicked to display the alignment dialog window, and "Beam" is selected. The STIGMA/ALIGNMENT knob (X,Y) on the operation panel is rotated to move beam displayed to the center of the concentric circle. Then, "Aperture" is selected, and the STIGMA/ALIGNMENT knob (X,Y) is turned once at a time and adjusted so as to stop or minimize image wobbling. The aperture dialog is closed, and the focus is adjusted by autofocus. The operation is further repeated twice to adjust the focus.

Thereafter, the particle diameters of at least 300 of the fine silica particles on the toner surface are measured, and the average particle diameter thereof is determined. Herein, some of the fine silica particles may be present as an aggregate, and thus the maximum diameters of the fine silica particles that can be confirmed as primary particles are determined and the resulting maximum diameters are arithmetically averaged to thereby provide the number average primary particle diameter (D1) of the fine silica particles.

<Measurement Method of Rate of Immobilization of Silicone Oil on Fine Silica Particle Based on Amount of Carbon>

(Extraction of Free Silicone Oil)

(1) The fine silica particle (0.50 g) and 40 ml of chloroform are placed in a beaker, and stirred for 2 hours.

(2) Stirring is stopped and the resultant is left to still stand for 12 hours.

(3) The sample is filtered and washed with 40 ml of chloroform three times.

(Determination of Amount of Carbon)

The sample is burned at 1100° C. under an oxygen stream, and the amounts of CO and $CO_2$ generated are measured by the IR absorbances to determine the amount of carbon in the sample. The amounts of carbon before and after extraction of the silicone oil are compared with each other, and the rate of immobilization of the silicone oil based on the amount of carbon is calculated as follows.

(1) The sample (0.40 g) is placed in a cylindrical mold and pressed.

(2) The sample pressed (0.15 g) is precisely weighed, put on a board for burning, and subjected to measurement by EMA-110 manufactured by Horiba Ltd.

(3)[Amount of carbon after extraction of silicone oil]/[Amount of carbon before extraction of silicone oil]×100 is defined as the rate of immobilization of the silicone oil based on the amount of carbon.

Herein, when the surface treatment with the silicone oil is performed after the hydrophobic treatment with the silane compound or the like, calculation is made as follows. The amount of carbon in the sample after the hydrophobic treatment with the silane compound or the like is determined, the sample is treated with the silicone oil, and thereafter the amounts of carbon before and after extraction of the silicone oil are compared with each other to calculate the rate of immobilization of the silicone oil based on the amount of carbon as follows.

(4)[Amount of carbon after extraction of silicone oil]/[(Amount of carbon before extraction of silicone oil−Amount of carbon after hydrophobic treatment with silane compound or the like)]×100 is defined as the rate of immobilization of the silicone oil based on the amount of carbon.

On the other hand, when the hydrophobic treatment with the silane compound or the like is performed after the surface treatment with the silicone oil, the rate of immobilization of the silicone oil based on the amount of carbon is calculated as follows.

(5)[(Amount of carbon after extraction of silicone oil−Amount of carbon after hydrophobic treatment with silane compound or the like)]/[Amount of carbon before extraction of silicone oil]×100 is defined as the rate of immobilization of the silicone oil based on the amount of carbon.

<Total Energy>

The total energy of the toner in the present invention is measured using a powder fluidity analyzer equipped with a rotary propeller type blade (Powder Rheometer FT-4 manufactured by Freeman Technology) (hereinafter, abbreviated as FT-4).

Specifically, the following operations are made for measurement. In all the operations, the propeller type blade used is a dedicated blade having a diameter of 23.5 mm for FT-4 measurement (Model number: C416, the material is SUS, hereinafter, referred to the blade).

First, 24 g of a toner left to stand in an environment of 23° C. and 60% for 3 days is placed in a dedicated vessel for FT-4 measurement (split vessel having a diameter of 25 mm and a volume of 25 ml (Model number: C4031), the height from the bottom of the vessel to the split portion is about 51 mm), and compacted to thereby form a toner powder layer.

A piston for a compacting test (diameter: 24 mm; height: 20 mm; the bottom portion is lined with a mesh) is used instead of the propeller type blade for compacting the toner.

(1) Compacting Operation of Toner

Eight g of the toner is added in the dedicated vessel for FT-4 measurement. A dedicated piston for a compacting test, for FT-4 measurement, is mounted, and compression is performed at 40 N for 60 seconds. Eight g of the toner is further added and the compression operation is similarly performed three times in total, resulting in the state where 24 g of the toner in total is compacted within the dedicated vessel.

(2) Splitting Operation

The toner powder layer is scraped and leveled at the split portion of the dedicated vessel for FT-4 measurement, and the toner on the upper portion of the toner powder layer is removed, thereby forming a toner powder layer having the same volume (25 mL).

(3) Measurement Operation (A) The propeller type blade is rotated in the clockwise direction with respect to the surface of the toner powder layer (in the direction where the toner powder layer is not pushed by rotation of the blade) at a peripheral velocity of the blade (peripheral velocity at the outermost edge of the blade) of 10 mm/sec. Then, the propeller type blade is advanced to a position of 10 mm from the bottom of the toner powder layer at a speed of ingression into the toner powder layer in the vertical direction so that the angle formed between the path traced by the outermost edge of the blade during movement and the powder layer surface (hereinafter, such an angle is also referred to as the "blade path angle") is 5 (deg).

(B) Thereafter, the propeller type blade is rotated in the clockwise direction with respect to the surface of the toner powder layer at a peripheral velocity of the blade of 60 mm/sec. Then, the propeller type blade is advanced to a position of 1 mm from the bottom of the toner powder layer at a speed of ingression into the toner powder layer in the vertical direction so that the blade path angle is 2 (deg).

(C) Thereafter, the propeller type blade is rotated in the counterclockwise direction with respect to the surface of the toner powder layer at a peripheral velocity of the blade of 10 mm/sec. Then, the propeller type blade is moved to a position of 80 mm from the bottom of the toner powder layer and drawn out at a speed of drawing out from the toner powder layer in the vertical direction so that the blade path angle is 5 (deg). After completion of the drawing out, the blade is alternately rotated a little in the clockwise and counterclockwise directions to knock off the toner attached to the blade.

In above measurement operation (A), the propeller type blade is advanced into the toner powder layer within the dedicated vessel while being rotated, and the measurement is started at a position of 60 mm from the bottom of the toner powder layer. Then, the sum of the rotational torque and vertical load obtained in advancing of the propeller type blade to a position of 10 mm from the bottom is defined as TE. The resulting TE is divided by the toner density within a cell during measurement (the toner density is automatically measured by FT-4), thereby providing the total energy [mJ/(g/ml)] in the present invention.

Hereinafter, the present invention is more specifically described with reference to Production Examples and Examples, but the present invention is not limited thereto at all. Herein, all part(s) in the following compoundings represent part(s) by mass.

(Preparation of Substrate 2)

A core metal made of SUS304, having a diameter of 6 mm and coated with a primer (trade name: DY35-051; produced by Dow Corning Toray Co., Ltd.) and baked was prepared as substrate 2.

(Production of Elastic Roller)

Substrate 2 prepared above was disposed in a mold, and an addition type silicone rubber composition in which the following materials were mixed was injected to the cavity formed in the mold:

- 100 parts by mass of a liquid silicone rubber material (trade name: SE6724A/B; produced by Dow Corning Toray Co., Ltd.),
- 15 parts by mass of carbon black (trade name: Toka Black #4300; produced by Tokai Carbon Co., Ltd.),
- 0.2 parts by mass of a silica powder as a heat resistance-imparting agent, and
- 0.1 parts by mass of a platinum catalyst.

The addition type silicone rubber composition in which the materials listed in Table 1 below were mixed was injected to the cavity formed in the mold. Subsequently, the mold was heated to vulcanize the silicone rubber at a temperature of 150° C. for 15 minutes, for curing. The substrate where a cured silicone rubber layer was formed around the periphery was released from the mold, and then the substrate was further heated at a temperature of 180° C. for 1 hour to complete the curing reaction of the silicone rubber layer. Thus, elastic roller D-1 was produced in which a silicone rubber elastic layer having a diameter of 12 mm was formed on the circumference of substrate 2.

(Preparation of Surface Layer 4)

Hereinafter, Synthesis Examples for providing a polyurethane surface layer in the present invention are shown.

(Synthesis of Isocyanate Group-Terminal Prepolymer A-1)

Under a nitrogen atmosphere, 100.0 g of a polypropylene glycol type polyol (trade name: Excenol 4030; produced by Asahi Glass Co., Ltd.) was gradually dropped to 17.7 parts by mass of tolylene diisocyanate (TDI) (trade name: Cosmonate T80; produced by Mitsui Chemicals, Inc.) in a reaction vessel while the temperature in the reaction vessel was kept at 65° C. After completion of the dropping, the resultant was reacted at a temperature of 65° C. for 2 hours. The resulting reaction mixture was cooled to room temperature to provide isocyanate group-terminal prepolymer A-1 having an isocyanate-group content of 3.8% by weight.

(Synthesis of Isocyanate Group-Terminal Prepolymer A-2)

Under a nitrogen atmosphere, 100.0 g of a butylene adipate type polyol (trade name: Nipporan 4010; produced by Nippon Polyurethane Industry Co., Ltd.) was gradually dropped to 33.8 parts by mass of a polymeric MDI (trade name: Millionate MR produced by Nippon Polyurethane Industry Co., Ltd.) in a reaction vessel while the temperature of the reaction vessel was kept at 65° C. After completion of the dropping, the resultant was reacted at a temperature of 65° C. for 2 hours. The resulting reaction mixture was cooled to room temperature to provide isocyanate group-terminal prepolymer A-2 having an isocyanate group-content of 4.3% by weight.

(Synthesis of Amino Compound (Compound Represented by Structural Formula (1)))

(Synthesis of Amino Compound B-1)

In a reaction vessel equipped with a stirring apparatus, a thermometer, a reflux tube, a dropping apparatus and a temperature adjustment apparatus, 100.0 parts by mass (1.67 mol) of ethylenediamine and 100 parts by mass of pure water were warmed to 40° C. under stirring. Then, while the reaction temperature was kept at 40° C. or lower, 425.3 parts by mass (7.35 mol) of propylene oxide was gradually dropped over 30 minutes. Stirring was performed for additional 1 hour for reaction, providing a reaction mixture. The resulting reaction mixture was heated under reduced pressure to distill off water, providing 426 g of amino compound B-1.

(Synthesis of Amino Compound B-2)

Amino compound B-2 was obtained in the same manner as in the synthesis example of amino compound B-1 except that the amount of propylene oxide compounded and the reaction time were changed as listed in Table 1 below.

TABLE 1

| | Type of amino compound as raw material | | Additional raw material | | |
|---|---|---|---|---|---|
| No. | Compound | Parts by mass | Compound | Parts by mass | Reaction time |
| B-1 | Ethylenediamine | 100.0 | Propylene | 425.3 | 1 h |
| B-2 | | | oxide | 1276.0 | 2 h |
| B-3 | Diethylenetriamine | | Ethylene oxide | 235.0 | 1 h |
| B-4 | | | 2-Methyl-tetrahydrofuran | 1377.7 | 2 h |
| B-5 | Tetraethylenepentamine | | 8-Bromo-1-octanol | 851.5 | 1.5 h |
| B-6 | Butylenediamine | | Ethyleneimine | 215.0 | 1 h |
| B-7 | | | 8-Bromo-1-aminooctane | 1040.0 | |

(Synthesis of Amino Compound B-3)

In a reaction vessel equipped with a stirring apparatus, a thermometer, a dropping apparatus and a temperature adjustment apparatus, 100.0 parts by mass (0.97 mol) of diethylenetriamine and 100 parts by mass of ethanol were warmed to 40° C. under stirring. Then, while the reaction temperature was kept at 60° C. or lower, 235.0 parts by mass (5.34 mol) of ethylene oxide was gradually dropped over 30 minutes. Stirring was performed for additional 1 hour for reaction, providing a reaction mixture. The resulting reaction mixture was heated under reduced pressure to distill off ethanol, providing 276 g of amino compound B-3.

(Synthesis of Amino Compound B-4)

Amino compound B-4 was obtained in the same manner as in the synthesis example of amino compound B-3 except that ethylene oxide was changed to 2-methyl-tetrahydrofuran, and the amount compounded and the reaction time were changed as listed in Table 1.

(Synthesis of Amino Compound B-5)

In a reaction vessel equipped with a stirring apparatus, a thermometer, a reflux tube, a dropping apparatus and a temperature adjustment apparatus, 100.0 parts by mass (0.53 mol) of tetraethylenepentamine and 100 parts by mass of ethanol were warmed to 40° C. under stirring. Then, while the reaction temperature was kept at 40° C. or lower, 851.5 parts by mass (4.08 mol) of 8-bromo-1-octanol was gradually dropped over 30 minutes. Stirring was performed for additional 1.5 hours for reaction, providing a reaction mixture. The resulting reaction mixture was heated under reduced pressure to distill off ethanol, providing 1288 g of amino compound B-5.

(Synthesis of Amino Compound B-6)

In a reaction vessel equipped with a stirring apparatus, a thermometer, a reflux tube, a dropping apparatus and a temperature adjustment apparatus, 100.0 parts by mass (1.14 mol) of butylenediamine and 100 parts by mass of ethanol were warmed to 40° C. under stirring. Then, while the reaction temperature was kept at 40° C. or lower, 215.0 parts by mass (5.02 mol) of ethyleneimine was gradually dropped over 30 minutes. Stirring was performed for additional 1 hour for reaction, providing a reaction mixture. The resulting reaction mixture was heated under reduced pressure to distill off ethanol, providing 216 g of amino compound B-6.

(Synthesis of Amino Compound B-7)

Amino compound B-7 was obtained in the same manner as in the synthesis example of amino compound B-6 except that ethyleneimine was changed to 8-bromo-1-aminooctane, and the amount compounded was changed as listed in Table 1.

The structure of each of the resulting amino compounds is shown in Table 2. In Table, n denotes the number of repeating amino structural units of structural formula (1) and m denotes the number of repeating ether units in which $R^3$ represents structural formula (2). In addition, the number of groups in Table represents the number of terminal hydroxyl groups or terminal amino groups in one molecule of each of the amino compounds.

TABLE 2

| Amino compound | | | | | | | |
|---|---|---|---|---|---|---|---|
| | | $R^3$ | $R^5$ | | | Terminal functional | Number of |
| No. | n | Structure | Structure | m | $R^4$ | group | groups |
| B-1 | 1 | —$CH_2CH(CH_3)$—OH | — | — | —$CH_2CH_2$— | OH | 4 |
| B-2 | | — | —$CH_2CH(CH_3)$—O— | 3 | | | 4 |
| B-3 | 2 | —$CH_2CH_2$—OH | — | — | | | 5 |
| B-4 | | — | —$CH_2CH_2CH(CH_3)CH_2$—O— | 3 | | | 5 |
| B-5 | 4 | —$(CH_2)_8$—OH | — | — | | | 7 |
| B-6 | 1 | —$CH_2CH_2$—$NH_2$ | — | — | —$(CH_2)_4$— | $NH_2$ | 4 |
| B-7 | | —$(CH_2)_8$—$NH_2$ | — | — | | | 4 |

Structural formula (1)

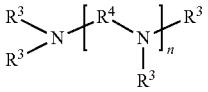

Structural formula (2)

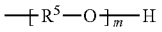

<Production of Toner Carrying Member 1>

The material of the surface layer 4 was obtained by mixing 34.2 parts by mass of amino compound B-1, 117.4 parts by mass of carbon black (trade name: MA230; produced by Mitsubishi Chemical Corporation) and 130.4 parts by mass of a urethane resin fine particle (trade name: Art Pearl C-400; produced by Negami Chemical Industrial Co., Ltd.) with 617.9 parts by mass of isocyanate group-terminal prepolymer A-1 under stirring.

Then, methyl ethyl ketone (hereinafter MEK) was added so that the total solid content rate was 30% by mass, and then the resultant was mixed in a sand mill. Then, furthermore, the viscosity was adjusted to 10 to 13 cps by MEK to prepare a coating material for surface layer formation.

Elastic roller D-1 produced in advance was immersed in the coating material for surface layer formation, and a coating film of the coating material was formed on the surface of the elastic layer of elastic roller D-1 and dried. The film was further heat-treated at a temperature of 150° C. for 1 hour to thereby provide a surface layer having a thickness of about 15 μm on the circumference of the elastic layer, producing toner carrying member 1.

<Production of Toner Carrying Members 2 to 7>

Each coating material for surface layer formation was prepared in the same manner as the production of toner carrying member 1 expect that materials in Table 3 below were used for the material of the surface layer 4. Then, elastic roller D-1 was coated with each coating material and the resulting film was dried and heated in the same manner as in the production of toner carrying member 1, producing each of toner carrying members 2 to 7.

TABLE 3

| Toner carrying | Isocyanate group-terminal prepolymer | | Compound of structural formula (1) | |
|---|---|---|---|---|
| member | No | Parts by mass | No | Parts by mass |
| 1 | A-1 | 617.9 | B-1 | 34.2 |
| 2 | | 545.0 | B-2 | 107.2 |
| 3 | | 618.9 | B-3 | 33.2 |
| 4 | A-2 | 527.7 | B-4 | 124.4 |
| 5 | | 575.6 | B-5 | 76.5 |

TABLE 3-continued

| Toner carrying | Isocyanate group-terminal prepolymer | | Compound of structural formula (1) | |
|---|---|---|---|---|
| member | No | Parts by mass | No | Parts by mass |
| 6 | | 623.7 | B-6 | 28.4 |
| 7 | | 584.0 | B-7 | 68.2 |

<Production of Toner Carrying Member 8>

The material of the surface layer 4 was obtained by mixing 19.5 parts by mass of pentaerythritol, 117.4 parts by mass of carbon black (trade name: MA230; produced by Mitsubishi Chemical Corporation) and 130.5 parts by mass of a urethane resin fine particle (trade name: Art Pearl C-400; produced by Negami Chemical Industrial Co., Ltd.) with 632.8 parts by mass of isocyanate group-terminal prepolymer A-2 under stirring.

Thereafter, a coating material for surface layer formation for toner carrying member 8 was prepared in the same manner as in the preparation method of the coating material for surface layer formation for the production of toner carrying member 1. The surface of the silicone rubber elastic layer of elastic roller D-1 was coated with the coating material for surface layer formation and the resulting film was dried to form a surface layer, providing toner carrying member 8, in the same manner as in the production of toner carrying member 1.

<Production of Toner Carrying Member 9>

The material of the surface layer 4 was obtained by mixing 300.5 parts by mass of a polypropylene glycol type polyol (trade name: Excenol 230; produced by Asahi Glass Co., Ltd.), 117.4 parts by mass of carbon black (trade name: MA230; produced by Mitsubishi Chemical Corporation) and 130.5 parts by mass of a urethane resin fine particle (trade name: Art Pearl C-400; produced by Negami Chemical Industrial Co., Ltd.) with 351.6 parts by mass of isocyanate group-terminal prepolymer A-2 under stirring.

Thereafter, a coating material for surface layer formation for toner carrying member 9 was prepared in the same manner as in the preparation method of the coating material for surface layer formation for the production of toner carrying member 1. The surface of the silicone rubber elastic layer of elastic roller D-1 was coated with the coating material for surface layer formation and the resulting film was dried to form a surface layer, providing toner carrying member 9, in the same manner as in the production of toner carrying member 1.

<Production of Magnetic Member 1>

A sodium hydroxide solution in 1.1 equivalents relative to the amount of an iron element, $P_2O_5$ in an amount of 0.15% by mass relative to the amount of an iron element by phosphorus element conversion, and $SiO_2$ in an amount of 0.50% by mass relative to the amount of an iron element by silicon element conversion were mixed with an aqueous ferrous sulfate solution to prepare an aqueous solution including ferrous hydroxide. The pH of the aqueous solution was adjusted to 7.5, and an oxidation reaction was performed at 85° C. while air was blown thereinto, thereby preparing a slurry liquid having a seed crystal.

Then, an aqueous ferrous sulfate solution was added to the slurry liquid so as to be in 1.1 equivalents relative to the amount of the initial alkali (sodium component of sodium hydroxide), and then an oxidation reaction was advanced while the pH of the slurry liquid was maintained at 7.4 and air was blown, thereby providing a slurry liquid including magnetic iron oxide. The slurry liquid was subjected to filtering and washing, and then the water-containing slurry liquid was taken out once. Here, a small amount of the water-containing sample was taken, and the water content was measured. Then, the water-containing sample, which was not dried, was loaded to another aqueous medium and re-dispersed by a pin mill with stirring while the slurry was circulated, and the pH of a re-dispersion was adjusted to about 5.0. Then, n-hexyltrimethoxysilane was added in an amount of 1.5 parts by mass based on 100 parts by mass of the magnetic iron oxide with stirring (the amount of the magnetic iron oxide was calculated as a value obtained by subtracting the water content from the amount of the water-containing sample), and hydrolyzed. Thereafter, dispersing was performed by a pin mill with sufficient stirring while the slurry was circulated, the pH of the dispersion was adjusted to 8.6, and a hydrophobization treatment was performed. The resulting hydrophobic magnetic member was subjected to filtering in a filter press, washed with a large amount of water and then dried at 100° C. for 15 minutes and at 90° C. for 30 minutes, and the resulting particle was subjected to a cracking treatment to provide magnetic member 1 having a volume average particle diameter (D3) of 0.22 μm.

<Production of Toner 1>

After 450 parts by mass of an aqueous 0.1 M-$Na_2PO_4$ solution was loaded to 720 parts by mass of ion-exchange water and warmed to 60° C., 67.7 parts by mass of an aqueous 1.0 M-$CaCl_2$ solution was added thereto, providing an aqueous medium including a dispersant.

78.0 parts by mass of styrene
22.0 parts by mass of n-butyl acrylate
0.48 parts by mass of divinyl benzene
1.5 parts by mass of a monoazo dye iron complex (T-77: produced by Hodogaya Chemical Co., Ltd.)
70.0 parts by mass of magnetic member 1
5.0 parts by mass of a polyester resin (saturated polyester resin obtained by the condensation reaction of an ethylene oxide adduct of bisphenol A with terephthalic acid, Mn=5000, acid value=6 mgKOH/g, Tg=68° C.)

The above materials were uniformly dispersed and mixed using Atriter (Mitsui Miike Kakoki Co., Ltd.) to provide a monomer composition. The monomer composition was warmed to 60° C., 10 parts by mass of a paraffin wax (melting point: 72° C.) was added thereto and mixed therewith, and dissolved therein, and then 4.5 parts by mass of 2,2'-azobis (2,4-dimethylvaleronitrile) as a polymerization initiator was dissolved therein.

The monomer composition was loaded to the above aqueous solution, and the resultant was stirred at 60° C. under a $N_2$ atmosphere by using a TK homomixer (Tokushukika Kogyo Co., Ltd.) at 12000 rpm for 10 minutes, and granulated. Thereafter, the resultant was reacted at 70° C. for 5 hours with stirring by a paddle stirring blade. After completion of the reaction, a suspension was cooled, washed by addition of hydrochloric acid, and subjected to filtering and drying to provide toner particle 1.

One hundred parts by mass of toner particle 1 and 0.5 parts by mass of silica produced by a sol-gel method and having a number average particle diameter (D1) of 100 nm were loaded to a Henschel mixer FM10C (Mitsui Miike Kakoki Co., Ltd.), and the resultant was mixed at 4000 rpm for 6 minutes (first external addition). Thereafter, 0.9 parts by mass of fine silica particle A was loaded and then mixed at 4000 rpm for 4 minutes (second external addition) to provide toner 1. The weight average particle diameter (D4) of toner 1 obtained was 8.2 μm, and the D4/D1, the ratio of the weight average particle diameter (D4) to the number average particle diameter (D1), was 1.12, and the total energy was 303 mJ/(g/ml). The production conditions and physical properties of toner 1 are shown in Table 5.

Herein, physical properties of first fine silica particles A to G used in Examples are shown in Table 4.

TABLE 4

Physical properties of silica fine particle

| First silica fine particle | First hydrophobization treatment | Second hydrophobization treatment | Number average particle diameter (D1) | Rate of immobilization of oil |
|---|---|---|---|---|
| Silica fine particle A | Dimethylsilicone oil: 30 parts | Hexamethyldisilazane: 10 parts | 12 nm | 100% |
| Silica fine particle B | Dimethylsilicone oil: 30 parts | Hexamethyldisilazane: 10 parts | 12 nm | 90% |
| Silica fine particle C | Dimethylsilicone oil: 30 parts | Hexamethyldisilazane: 10 parts | 12 nm | 85% |
| Silica fine particle D | Hexamethyldisilazane: 10 parts | Dimethylsilicone oil: 30 parts | 12 nm | 10% |
| Silica fine particle E | Hexamethyldisilazane: 10 parts | Dimethylsilicone oil: 30 parts | 8 nm | 8% |
| Silica fine particle F | Hexamethyldisilazane: 10 parts | Dimethylsilicone oil: 30 parts | 20 nm | 12% |
| Silica fine particle G | Hexamethyldisilazane: 10 parts | Dimethylsilicone oil: 30 parts | 35 nm | 15% |

Herein, with respect to each of fine silica particles A to G, a silica raw material (fumed silica) was subjected to a first hydrophobization treatment and then a second hydrophobization treatment to provide each of fine silica particles A to G.

<Production of Toners 2 To 19>

Each of toners 2 to 19 was obtained in the same manner as in the production of toner 1 except that the first external addition and the second external addition were changed as shown in Table 5. The production conditions and physical properties of toners 2 to 19 are shown in Table 5.

TABLE 5

| | First external addition | | | Second external addition | | | Total |
|---|---|---|---|---|---|---|---|
| | Type of silica | Number average particle diameter | Parts added | Type of silica | Number average particle diameter | Parts added | energy of toner mJ/(g/ml) |
| Toner 1 | Sol-gel silica | 100 nm | 0.5 parts | Silica fine particle A | 12 nm | 0.9 parts | 303 |
| Toner 2 | Sol-gel silica | 100 nm | 0.5 parts | Silica fine particle B | 12 nm | 0.9 parts | 300 |
| Toner 3 | Sol-gel silica | 100 nm | 0.5 parts | Silica fine particle C | 12 nm | 0.9 parts | 294 |
| Toner 4 | Sol-gel silica | 100 nm | 0.5 parts | Silica fine particle D | 12 nm | 0.9 parts | 296 |
| Toner 5 | — | — | — | Sol-gel silica | 100 nm | 0.5 parts | 312 |
| | | | | Silica fine particle D | 12 nm | 0.9 parts | |
| Toner 6 | — | — | — | Sol-gel silica | 100 nm | 0.1 parts | 355 |
| | | | | Silica fine particle D | 12 nm | 0.9 parts | |
| Toner 7 | — | — | — | Sol-gel silica | 100 nm | 0.3 parts | 328 |
| | | | | Silica fine particle D | 12 nm | 0.9 parts | |
| Toner 8 | — | — | — | Sol-gel silica | 100 nm | 0.7 parts | 270 |
| | | | | Silica fine particle D | 12 nm | 0.9 parts | |
| Toner 9 | — | — | — | Sol-gel silica | 40 nm | 0.5 parts | 276 |
| | | | | Silica fine particle D | 12 nm | 0.9 parts | |
| Toner 10 | — | — | — | Sol-gel silica | 200 nm | 0.5 parts | 345 |
| | | | | Silica fine particle D | 12 nm | 0.9 parts | |
| Toner 11 | — | — | — | Sol-gel silica | 100 nm | 0.5 parts | 284 |
| | | | | Silica fine particle E | 8 nm | 0.9 parts | |
| Toner 12 | — | — | — | Sol-gel silica | 100 nm | 0.5 parts | 352 |
| | | | | Silica fine particle F | 20 nm | 0.9 parts | |
| Toner 13 | — | — | — | Silica fine particle D | 12 nm | 0.9 parts | 368 |
| Toner 14 | — | — | — | Silica fine particle D | 12 nm | 1.5 parts | 335 |
| Toner 15 | — | — | — | Sol-gel silica | 100 nm | 0.1 parts | 371 |
| | | | | Silica fine particle D | 12 nm | 0.4 parts | |
| Toner 16 | — | — | — | Sol-gel silica | 100 nm | 1.0 parts | 237 |
| | | | | Silica fine particle D | 12 nm | 0.9 parts | |
| Toner 17 | — | — | — | Fumed silica | 50 nm | 0.3 parts | 348 |
| | | | | Silica fine particle D | 12 nm | 0.9 parts | |
| Toner 18 | — | — | — | Fumed silica | 100 nm | 0.3 parts | 352 |
| | | | | Silica fine particle D | 12 nm | 0.9 parts | |
| Toner 19 | — | — | — | Sol-gel silica | 100 nm | 0.5 parts | 382 |
| | | | | Silica fine particle G | 35 nm | 0.9 parts | |

In Table, "Sol-gel silica" of each of toners 1 to 12, 15, 16 and 19 represents the second fine silica particle produced by a sol-gel method. In addition, "fumed silica" of each of toners 17 and 18 represents a fumed silica used instead of the second fine silica particle produced by a sol-gel method.

EXAMPLE 1

(Image Forming Apparatus)

A printer LBP 7700C manufactured by Canon Inc. was altered and used for image output evaluation. Alteration was made so that the toner supply member of the developing apparatus was allowed to be rotated backward with respect to the toner carrying member as illustrated in FIG. 2 and voltage application to the toner supply member was turned off. Herein, the abutment pressure was adjusted so that the width of the abutment portion between the toner carrying member and the electrostatic latent image bearing member was 1.1 mm. Thus, the regulation failure can be severely evaluated. In addition, alteration was made so that voltage application to the regulating member (blade) was also turned off and the fogging under a high-temperature and high-humidity environment was severely evaluated.

The developing apparatus thus altered was filled with 100 g of toner 1, and toner carrying member 2 was used to produce a developing apparatus. The developing apparatus produced was set on a black station, and an image was output under a high-temperature and high-humidity environment (40° C./95% RH) and a low-temperature and low-humidity environment (15° C./10% RH) for 3000 sheets. Herein, a lateral line was used as the image so that the printing rate was 2%, and an image output test was performed with sheets being continuously fed.

As a result, a clear image with no fogging was obtained under a high-temperature and high-humidity environment, the difference between the amount of the toner on the toner carrying member after white and the amount of the toner on the toner carrying member after black imaging was small even under a low-temperature and low-humidity environment, and thus a good image could be obtained. The evaluation results are shown in Table 6.

The evaluation methods and the determination criteria of each evaluation performed in Examples and Comparative Examples of the present invention are described below.

<Image Density>

The image density was determined by forming a solid image area and measuring the density of the solid image by a Macbeth reflection densitometer (manufactured by Macbeth).

<Fogging>

A white image was output, and the reflectance thereof was measured using REFLECTMETER MODEL TC-6DS manufactured by Tokyo Denshoku Co., Ltd. On the other hand, the reflectance of transfer paper (standard paper) before white image formation was also measured in the same manner. As a filter, a green filter was used. From the reflectances before and after the white image was output, the following equation was used to calculate the fogging.

Fogging (reflectance) (%)=Reflectance of standard paper (%)−Reflectance of white image sample (%)

Herein, the determination criteria of the fogging are as follows.

A: very good level (fogging: less than 1.5%)

B: good level (fogging: 1.5% or more and less than 2.5%)

C: practically no-problematic level (fogging: 2.5% or more and less than 3.5%)

D: practically undesirable level (fogging: 3.5% or more)

<Regulation Failure>

The regulation failure was evaluated by the difference between the amount of the toner on the toner carrying member after white and the amount of the toner on the toner carrying member after black imaging.

Herein, the determination criteria of the regulation failure are as follows.

A: the difference between the amount of the toner after white and the amount of the toner after black imaging was less than 1.0 g/m$^2$; very good.

B: the difference between the amount of the toner after white and the amount of the toner after black imaging was 1.0 g/m$^2$ or more and less than 2.0 g/m$^2$; good.

C: the difference between the amount of the toner after white and the amount of the toner after black imaging was 2.0 g/m$^2$ or more and less than 3.0 g/m$^2$; practically no-problematic level.

EXAMPLES 2 TO 19

Each of developing apparatuses was produced by a combination of each toner with each toner carrying member as shown in Table 6, and each of the developing apparatuses was subjected to image output evaluation in the same manner as in Example 1. Consequently, all the developing apparatuses exhibited good results with respect to both of the fogging under a high-temperature and high-humidity environment and the regulation failure under a low-temperature and low-humidity environment before and after a durability test. The evaluation results are shown in Table 6.

REFERENCE EXAMPLES 1 TO 7

Each of developing apparatuses was produced by a combination of each toner with each toner carrying member as shown in Table 6, and each of the developing apparatuses was subjected to image output evaluation in the same manner as in Example 1. Consequently, all the developing apparatuses exhibited practically non-problematic results with respect to both of the fogging under a high-temperature and high-humidity environment and the regulation failure under a low-temperature and low-humidity environment before and after a durability test. The evaluation results are shown in Table 6.

COMPARATIVE EXAMPLES 1 AND 2

Each of developing apparatuses was produced by a combination of each toner with each toner carrying member as shown in Table 6, and each of the developing apparatuses was subjected to image output evaluation in the same manner as in Example 1. Consequently, all the developing apparatuses exhibited practically non-problematic results with respect to the regulation failure under a low-temperature and low-humidity environment, but exhibited poorer results with respect to the fogging under a high-temperature and high-humidity environment than the results in Examples. The evaluation results are shown in Table 6.

TABLE 6

| | | | High-temperature and high-humidity environment | | | | Low-temperature and low-humidity environment | | | |
|---|---|---|---|---|---|---|---|---|---|---|
| | | | | | | | | | After image output for 3000 sheets | |
| | | Toner carrying | Initial | | After image output for 3000 sheets | | Initial | | | |
| | Toner | member | Density | Fogging | Density | Fogging | Density | Regulation failure | Density | Regulation failure |
| Example 1 | Toner 1 | 2 | 1.45 | A | 1.42 | A | 1.43 | A | 1.41 | A |
| Example 2 | Toner 1 | 3 | 1.45 | A | 1.43 | A | 1.44 | A | 1.42 | A |
| Example 3 | Toner 2 | 3 | 1.44 | A | 1.42 | A | 1.43 | A | 1.4 | A |
| Example 4 | Toner 3 | 3 | 1.42 | A | 1.4 | B | 1.42 | A | 1.4 | A |
| Example 5 | Toner 4 | 3 | 1.38 | A | 1.36 | B | 1.4 | A | 1.36 | B |
| Example 6 | Toner 5 | 3 | 1.35 | A | 1.33 | B | 1.4 | B | 1.39 | B |
| Example 7 | Toner 6 | 3 | 1.4 | A | 1.37 | B | 1.36 | B | 1.31 | B |
| Example 8 | Toner 7 | 3 | 1.38 | A | 1.35 | B | 1.38 | B | 1.36 | B |
| Example 9 | Toner 8 | 3 | 1.34 | B | 1.32 | B | 1.42 | A | 1.38 | B |
| Example 10 | Toner 9 | 3 | 1.33 | B | 1.31 | B | 1.41 | A | 1.38 | B |
| Example 11 | Toner 10 | 3 | 1.38 | A | 1.35 | B | 1.37 | B | 1.34 | B |
| Example 12 | Toner 11 | 3 | 1.45 | A | 1.34 | B | 1.44 | B | 1.39 | B |
| Example 13 | Toner 12 | 3 | 1.34 | A | 1.33 | B | 1.35 | B | 1.35 | B |
| Example 14 | Toner 5 | 2 | 1.38 | A | 1.36 | B | 1.38 | B | 1.35 | B |
| Example 15 | Toner 5 | 1 | 1.38 | B | 1.35 | B | 1.36 | B | 1.33 | B |
| Example 16 | Toner 5 | 4 | 1.37 | B | 1.35 | B | 1.35 | B | 1.33 | B |
| Example 17 | Toner 5 | 5 | 1.36 | B | 1.35 | B | 1.37 | B | 1.35 | B |
| Example 18 | Toner 5 | 6 | 1.38 | B | 1.36 | B | 1.36 | B | 1.33 | B |
| Example 19 | Toner 5 | 7 | 1.38 | B | 1.34 | B | 1.37 | B | 1.35 | B |
| Reference Example 1 | Toner 13 | 3 | 1.38 | A | 1.34 | C | 1.33 | C | 1.3 | C |
| Reference Example 2 | Toner 14 | 3 | 1.4 | B | 1.36 | C | 1.36 | B | 1.32 | C |

TABLE 6-continued

| | | | High-temperature and high-humidity environment | | | | Low-temperature and low-humidity environment | | | |
|---|---|---|---|---|---|---|---|---|---|---|
| | | Toner carrying | Initial | | After image output for 3000 sheets | | Initial | | After image output for 3000 sheets | |
| | Toner | member | Density | Fogging | Density | Fogging | Density | Regulation failure | Density | Regulation failure |
| Reference Example 3 | Toner 15 | 3 | 1.35 | B | 1.3 | B | 1.34 | C | 1.3 | C |
| Reference Example 4 | Toner 16 | 3 | 1.32 | C | 1.3 | C | 1.38 | A | 1.35 | A |
| Reference Example 5 | Toner 17 | 3 | 1.38 | B | 1.35 | B | 1.36 | C | 1.33 | C |
| Reference Example 6 | Toner 18 | 3 | 1.37 | B | 1.35 | B | 1.34 | C | 1.31 | C |
| Reference Example 7 | Toner 19 | 3 | 1.32 | B | 1.3 | C | 1.34 | C | 1.3 | C |
| Comparative Example 1 | Toner 5 | 8 | 1.31 | D | 1.22 | D | 1.38 | A | 1.36 | B |
| Comparative Example 2 | Toner 5 | 9 | 1.33 | D | 1.24 | D | 1.37 | A | 1.35 | B |

<Production of Toner Carrying Member 10>

(Preparation of Substrate)

An aluminum cylindrical tube subjected to grinding processing, having an outer diameter of 10 mmϕ (diameter) and an arithmetic average roughness Ra of 0.2 μm, as the substrate 2 was coated with a primer (trade name: DY35-051; produced by Dow Corning Toray Co., Ltd.), and baked.

(Production of Elastic Roller)

The substrate prepared above was disposed in a mold, and an addition type silicone rubber composition in which the following materials were mixed was injected to the cavity formed in the mold:

100 parts by mass of a liquid silicone rubber material (trade name: SE6724A/B; produced by Dow Corning Toray Co., Ltd.)

15 parts by mass of carbon black (trade name: Toka Black #4300; produced by Tokai Carbon Co., Ltd.)

0.2 parts by mass of a silica powder as a heat resistance-imparting agent, and 0.1 parts by mass of a platinum catalyst.

Subsequently, the mold was heated to vulcanize the silicone rubber at a temperature of 150° C. for 15 minutes, for curing. The substrate where a cured silicone rubber layer was formed around the periphery was released from the mold, and then the substrate was further heated at a temperature of 180° C. for 1 hour to complete the curing reaction of the silicone rubber layer. Thus, elastic roller D-2 was produced in which a silicone rubber elastic layer having a thickness of 0.5 mm and a diameter of 11 mm was formed on the circumference of substrate 2.

(Production of Surface Layer)

The material of the surface layer 4 was obtained by mixing 34.2 parts by mass of amino compound B-1, 117.4 parts by mass of carbon black (trade name: MA230; produced by Mitsubishi Chemical Corporation) and 130.4 parts by mass of a urethane resin fine particle (trade name: Art Pearl C-400; produced by Negami Chemical Industrial Co., Ltd.) with 617.9 parts by mass of isocyanate group-terminal prepolymer A-1 under stirring.

Then, MEK was added so that the total solid content rate was 30% by mass, to prepare a coating material for surface layer formation.

Then, an area of elastic roller D-2 produced above, on which no rubber was present, was masked and allowed to vertically stand, and coated with the coating material with being rotated at 1500 rpm and a spray gun being let down at 30 mm/s. Subsequently, a coating layer was heated in a hot air drying furnace at a temperature of 180° C. for 20 minutes for curing and drying, thereby providing a surface layer having a thickness of about 8 μm on the circumference of the elastic layer to produce toner carrying member 10.

<Production of Toner Carrying Members 11 to 16>

Each of coating materials for surface layer formation was prepared in the same manner as in the production of toner carrying member 10 except that materials in Table 7 below were used for the material of the surface layer 4. Then, elastic roller D-2 was coated with each of the coating materials, and dried and heated in the same manner as in the production of toner carrying member 10 to produce each of toner carrying members 11 to 16.

TABLE 7

| Toner | Isocyanate group-terminal prepolymer | | Compound of structural formula (1) | |
|---|---|---|---|---|
| carrying member | No. | Parts by mass | No. | Parts by mass |
| 10 | A-1 | 617.9 | B-1 | 34.2 |
| 11 | | 545.0 | B-2 | 107.2 |
| 12 | | 618.9 | B-3 | 33.2 |
| 13 | A-2 | 527.7 | B-4 | 124.4 |
| 14 | | 575.6 | B-5 | 76.5 |
| 15 | | 623.7 | B-6 | 28.4 |
| 16 | | 584.0 | B-7 | 68.2 |

EXAMPLE 20

A printer LBP 3100C manufactured by Canon Inc. was altered and used for image output evaluation. Alteration was made so that toner carrying member 7 abutted with the electrostatic latent image bearing member as illustrated in FIG. 4. Herein, the abutment pressure was adjusted so that the width of the abutment portion between the toner carrying member and the electrostatic latent image bearing member was 1.0 mm. No toner supply member was provided and thus the toner on the toner carrying member could not be scraped, thereby making evaluation conditions very severe with respect to the regulation failure. In addition, no toner supply member was provided and thus the amount of the toner charged was small, thereby making conditions severe also with respect to the fogging under a high-temperature and high-humidity environment.

The developing apparatus thus altered was filled with 50 g of toner 1, and toner carrying member 10 was used to produce a developing apparatus. The developing apparatus produced was used to output an image in a high-temperature and high-humidity environment (40° C./95% RH) and a low-temperature and low-humidity environment (15° C./10% RH) for 1500 sheets. Herein, a lateral line was used as the image so that the printing rate was 2%, and an image output test was performed with sheets being continuously fed.

As a result, a clear image with no fogging was achieved under a high-temperature and high-humidity environment, the difference between the amount of the toner on the toner carrying member after white and the amount of the toner on the toner carrying member after black imaging was small even under a low-temperature and low-humidity environment, and thus a good image could be obtained. The evaluation results are shown in Table 8.

EXAMPLES 21 TO 26

Each of developing apparatuses was produced by a combination of each toner with each toner carrying member as shown in Table 8, and each of the developing apparatuses was subjected to image output evaluation in the same manner as in Example 23. Consequently, all the developing apparatuses exhibited good results with respect to both of the fogging under a high-temperature and high-humidity environment and the regulation failure under a low-temperature and low-humidity environment before and after a durability test. The evaluation results are shown in Table 8.

TABLE 8

| | | | High-temperature and high-humidity environment | | | | Low-temperature and low-humidity environment | | | |
|---|---|---|---|---|---|---|---|---|---|---|
| | | | | | | | | | After image output for 1500 sheets | |
| | | Toner carrying | Initial | | After image output for 1500 sheets | | Initial | | | |
| | Toner | member | Density | Fogging | Density | Fogging | Density | Regulation failure | Density | Regulation failure |
| Example 20 | Toner 1 | 10 | 1.43 | A | 1.41 | B | 1.44 | A | 1.42 | A |
| Example 21 | Toner 1 | 11 | 1.46 | A | 1.44 | A | 1.45 | A | 1.43 | A |
| Example 22 | Toner 1 | 12 | 1.46 | A | 1.43 | A | 1.46 | A | 1.44 | A |
| Example 23 | Toner 1 | 13 | 1.42 | A | 1.4 | B | 1.43 | A | 1.41 | A |
| Example 24 | Toner 1 | 14 | 1.44 | A | 1.41 | B | 1.44 | A | 1.42 | A |
| Example 25 | Toner 1 | 15 | 1.45 | A | 1.4 | B | 1.42 | A | 1.4 | A |
| Example 26 | Toner 1 | 16 | 1.43 | A | 1.4 | B | 1.44 | A | 1.42 | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-270525, filed Dec. 26, 2013, which is hereby incorporated by reference herein in its entirety.

What is claimed is:

1. A developing apparatus for developing an electrostatic latent image formed on a surface of an electrostatic latent image bearing member to form a toner image on the surface of the electrostatic latent image bearing member, wherein the developing apparatus comprises a toner for developing the electrostatic latent image, a toner carrying member for carrying the toner, and a regulating member for regulating a layer thickness of the toner carried by the toner carrying member, the toner is a magnetic toner comprising a toner particle containing a binder resin and a magnetic member, a first fine silica particle having a number average primary particle diameter (D1) of 5 nm or more and 20 nm or less, and a second fine silica particle having a number average primary particle diameter (D1) of 40 nm or more and 200 nm or less, the second fine silica particle is a fine silica particle produced by a sol-gel method, the toner has a total energy of 270 mJ/(g/ml) or more and 355 mJ/(g/ml) or less, the toner carrying member has a substrate, an elastic layer and a surface layer comprising a urethane resin, and the urethane resin has a partial structure derived from a reaction of a compound represented by the following structural formula (1) with a polyisocyanate:

Structural formula (1)

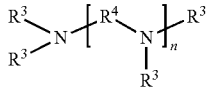

wherein n denotes an integer of 1 or more and 4 or less, each $R^3$ independently represents any selected from the group consisting of the following (a) to (c):

(a) a hydroxyalkyl group having 2 or more and 8 or less carbon atoms;

(b) an aminoalkyl group having 2 or more and 8 or less carbon atoms; and (c) a group represented by the following structural formula (2), and $R^4$ represents an alkylene group having 2 or more and 4 or less carbon atoms:

Structural formula (2)

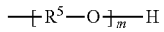

wherein m denotes an integer of 2 or more and 3 or less, and $R^5$ represents an alkylene group having 2 or more and 5 or less carbon atoms.

2. The developing apparatus according to claim 1, wherein the first fine silica particle is obtained by treating a silica raw material with a silicone oil and then with at least one of alkoxysilane and silazane.

3. The developing apparatus according to claim 2, wherein a rate of immobilization of the silicone oil on the first fine silica particle on carbon basis is 90% or more.

4. A developing method comprising using a developing apparatus for developing an electrostatic latent image formed on a surface of an electrostatic latent image bearing member to form a toner image on the surface of the electrostatic latent image bearing member, wherein the developing apparatus comprises a toner for developing the electrostatic latent image, a toner carrying member for carrying the toner, and a regulating member for regulating a layer thickness of the toner carried by the toner carrying member, the toner is a magnetic toner comprising a toner particle containing a binder resin and a magnetic member, a first fine silica particle having a number average primary particle diameter (D1) of 5 nm or more and 20 nm or less, and a second fine silica particle having a number average primary particle diameter (D1) of 40 nm or more and 200 nm or less, the second fine silica particle is a fine silica particle produced by a sol-gel method, the toner has a total energy of 270 mJ/(g/ml) or more and 355 mJ/(g/ml) or less, the toner carrying member has a substrate, an elastic layer and a surface layer comprising a urethane resin, and the urethane resin has a partial structure derived from a reaction of a compound represented by the following structural formula (1) with a polyisocyanate:

Structural formula (1)

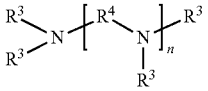

wherein n denotes an integer of 1 or more and 4 or less, each $R^3$ independently represents any selected from the group consisting of the following (a) to (c):

(a) a hydroxyalkyl group having 2 or more and 8 or less carbon atoms;

(b) an aminoalkyl group having 2 or more and 8 or less carbon atoms; and (c) a group represented by the following structural formula (2), and $R^4$ represents an alkylene group having 2 or more and 4 or less carbon atoms:

Structural formula (2)

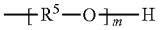

wherein m denotes an integer of 2 or more and 3 or less, and $R^5$ represents an alkylene group having 2 or more and 5 or less carbon atoms.

5. The developing method according to claim 4, wherein the first fine silica particle is obtained by treating a silica raw material with a silicone oil and then with at least one of alkoxysilane and silazane.

6. The developing method according to claim 5, wherein a rate of immobilization of the silicone oil on the first fine silica particle on carbon basis is 90% or more.

7. An image forming apparatus comprising an electrostatic latent image bearing member, a charging unit for charging a surface of the electrostatic latent image bearing member, an image exposure unit for irradiating the charged surface of the electrostatic latent image bearing member with light for image exposure to form an electrostatic latent image on the surface of the electrostatic latent image bearing member, a developing apparatus for developing the electrostatic latent image formed on the surface of the electrostatic latent image bearing member to form a toner image on the surface of the electrostatic latent image bearing member, a transfer unit for transferring the toner image formed on the surface of the electrostatic latent image bearing member to a transfer material via or not via an intermediate transfer member, and a fixing unit for fixing the toner image transferred to the transfer material to the transfer material, wherein the developing apparatus is the developing apparatus according to claim 1.

8. An image forming method comprising charging a surface of an electrostatic latent image bearing member, irradiating the charged surface of the electrostatic latent image bearing member with light for image exposure to form an electrostatic latent image on the surface of the electrostatic latent image bearing member, developing the electrostatic latent image formed on the surface of the electrostatic latent image bearing member to form a toner image on the surface of the electrostatic latent image bearing member, transferring the toner image formed on the surface of the electrostatic latent image bearing member to a transfer material via or not via an intermediate transfer member, and fixing the toner image transferred to the transfer material to the transfer material, wherein the developing is performed by the developing method according to claim 4.

* * * * *